US010160613B2

(12) United States Patent
Tanaka et al.

(10) Patent No.: US 10,160,613 B2
(45) Date of Patent: Dec. 25, 2018

(54) SHEET FEEDER AND IMAGE FORMING APPARATUS INCORPORATING THE SHEET FEEDER

(71) Applicants: Tomoya Tanaka, Kanagawa (JP); Mizuna Tanaka, Osaka (JP); Toshikane Nishii, Osaka (JP); Ikuo Fujii, Hyogo (JP); Hirofumi Horita, Kanagawa (JP)

(72) Inventors: Tomoya Tanaka, Kanagawa (JP); Mizuna Tanaka, Osaka (JP); Toshikane Nishii, Osaka (JP); Ikuo Fujii, Hyogo (JP); Hirofumi Horita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 54 days.

(21) Appl. No.: 15/180,475

(22) Filed: Jun. 13, 2016

(65) Prior Publication Data

US 2016/0378042 A1 Dec. 29, 2016

(30) Foreign Application Priority Data

Jun. 26, 2015 (JP) ..... 2015-128610

(51) Int. Cl.
*B65H 7/02* (2006.01)
*G03G 15/00* (2006.01)
(Continued)

(52) U.S. Cl.
CPC ..... *B65H 7/02* (2013.01); *B65H 3/0661* (2013.01); *B65H 3/5223* (2013.01); *B65H 5/062* (2013.01);
(Continued)

(58) Field of Classification Search
CPC ... B65H 1/04; B65H 1/08; B65H 3/02; B65H 3/06; B65H 3/0653; B65H 3/5207;
(Continued)

(56) References Cited

U.S. PATENT DOCUMENTS 6,786,481 B2 * 9/2004 Kawai ..... B65H 3/0661 271/109
7,635,127 B2 * 12/2009 Kuse ..... B65H 3/06 271/10.01
(Continued)

FOREIGN PATENT DOCUMENTS

JP 5-004740 1/1993
JP 08319037 A * 12/1996
(Continued)

*Primary Examiner* — Ernesto A Suarez
(74) *Attorney, Agent, or Firm* — Harness, Dickey & Pierce, P.L.C.

(57) ABSTRACT

A sheet feeder, which is included in an image forming apparatus, includes a sheet loader on which a sheet is loaded, a sheet feeding body to feed the sheet from the sheet loader, and a sheet separator disposed to contact the sheet feeding body. The sheet is fed at a first average sheet feeding speed at which the sheet feeding body is in contact with the sheet separator without holding the sheet with the sheet separator. The sheet is fed at a second average sheet feeding speed at which the sheet feeding body is holding the sheet with the sheet separator. The first average sheet feeding speed is set smaller than the second average sheet feeding speed.

20 Claims, 26 Drawing Sheets

(51) Int. Cl.
*B65H 5/06* (2006.01)
*B65H 3/52* (2006.01)
*B65H 3/06* (2006.01)

(52) U.S. Cl.
CPC ..... *G03G 15/6511* (2013.01); *G03G 15/6529* (2013.01); *B65H 2515/82* (2013.01); *B65H 2601/521* (2013.01); *G03G 2215/00396* (2013.01); *G03G 2215/0132* (2013.01)

(58) Field of Classification Search
CPC ..... B65H 3/5215; B65H 3/5223; B65H 7/02; B65H 7/14; B65H 7/18; B65H 2515/82; B65H 2601/125; B65H 2601/521; B65H 2601/524; B65H 3/0661; B65H 3/52
See application file for complete search history.

(56) References Cited

U.S. PATENT DOCUMENTS 7,770,881 B2 * 8/2010 Yokemura ..... B65H 3/06 271/10.11
2005/0225022 A1 * 10/2005 Akiyama ..... B65H 3/0615 271/10.03
2008/0143046 A1 6/2008 Nishii et al.
2008/0224385 A1 9/2008 Takahira et al.
2008/0237970 A1 10/2008 Tanaka et al.
2009/0110459 A1 4/2009 Honda et al.
2009/0174135 A1 7/2009 Tanaka et al.
2009/0302530 A1 * 12/2009 Darsosumarto ..... B41J 13/0018 271/265.01
2009/0315250 A1 12/2009 Kimura et al.
2010/0019440 A1 1/2010 Fujiwara et al.
2010/0059930 A1 3/2010 Tanaka et al.
2010/0156029 A1 * 6/2010 Kwak ..... B65H 3/0669 271/10.13
2010/0221051 A1 9/2010 Yamazaki et al.
2010/0225041 A1 9/2010 Matsuyama et al.
2011/0204556 A1 8/2011 Takahira et al.
2011/0217058 A1 9/2011 Honda et al.
2011/0291353 A1 12/2011 Fujiwara et al.
2012/0061907 A1 3/2012 Matsuyama et al.
2012/0063829 A1 3/2012 Matsuyama et al.
2012/0104690 A1 5/2012 Tanaka et al.
2012/0146281 A1 6/2012 Nishii et al.
2013/0043647 A1 * 2/2013 Fujii ..... G03G 15/6564 271/226
2014/0091518 A1 4/2014 Nishii et al.
2014/0319759 A1 10/2014 Fujii et al.
2015/0014919 A1 1/2015 Nakamura et al.
2015/0061217 A1 * 3/2015 Minakuchi ..... B65H 3/44 271/258.01

FOREIGN PATENT DOCUMENTS

JP 9-221240 8/1997
JP 2002-154694 5/2002
JP 2002-240966 8/2002
JP 2003-341854 12/2003
JP 2005-247556 9/2005
JP 2006-008328 1/2006
JP 2007-314258 12/2007
JP 2009-161301 7/2009

* cited by examiner

SHEET FEEDER AND IMAGE FORMING APPARATUS INCORPORATING THE SHEET FEEDER

CROSS-REFERENCE TO RELATED APPLICATIONS

This patent application is based on and claims priority pursuant to 35 U.S.C. § 119(a) to Japanese Patent Application No. 2015-128610, filed on Jun. 26, 2015, in the Japan Patent Office, the entire disclosure of which is hereby incorporated by reference herein.

BACKGROUND

Technical Field

This disclosure relates to a sheet feeder and an image forming apparatus including the sheet feeder.

Related Art

Various types of known image forming apparatuses generally include a sheet feeder having a pad-type sheet separator for separating a sheet one by one with a friction pad from a bundle of sheets accommodated in a sheet container.

Generally, such a friction pad includes a material having high coefficient of friction such as rubber and is biased by a biasing member such as a spring. As a sheet feed roller rotates to start sheet feeding, two or more sheets can be fed at the same time. Even if two sheets are fed together, the lower sheet is stopped due to friction with the friction pad, and therefore the upper sheet (or the uppermost sheet) is separated and fed forward.

Other than the above-described separation pad that separates the uppermost sheet and the lower subsequent sheet, a friction pad may also be applied to a bottom plate pad to separate the lowermost sheet and an upper subsequent sheet. In this case, the lowermost sheet is stopped by friction with the bottom plate pad, so that the upper subsequent sheet is separated and fed forward.

SUMMARY

At least one aspect of this disclosure provides a sheet feeder including a sheet loader on which a sheet is loaded, a sheet feeding body to feed the sheet from the sheet loader, and a sheet separator disposed to contact the sheet feeding body. The sheet is fed at a first average sheet feeding speed at which the sheet feeding body is in contact with the sheet separator without holding the sheet with the sheet separator. The sheet is fed at a second average sheet feeding speed at which the sheet feeding body is holding the sheet with the sheet separator. The first average sheet feeding speed is set smaller than the second average sheet feeding speed.

Further, at least one aspect of this disclosure provides an image forming apparatus including the above-described sheet feeder.

Further, at least one aspect of this disclosure provides an image forming apparatus including an image forming device to form an image on a sheet, and the above-described sheet feeder to feed the sheet to the image forming device.

DETAILED DESCRIPTION

Figure 1:
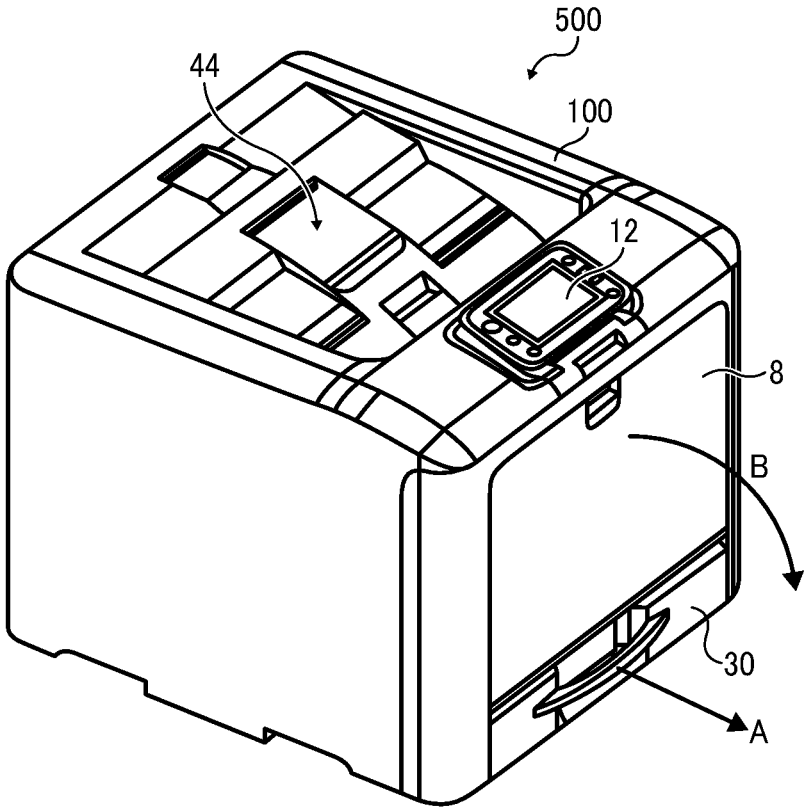
FIG. 1 is a perspective view illustrating an exterior of an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

A description is given of a sheet feeder and an image forming apparatus incorporating the sheet feeder according to an embodiment of this disclosure with reference to the drawings attached. It is to be noted that elements (for example, mechanical parts and components) having the same functions and shapes are denoted by the same reference numerals throughout the specification and redundant descriptions are omitted.

A description is given of an entire configuration and functions of an image forming apparatus 500 according to an embodiment of this disclosure.

Figure 2:
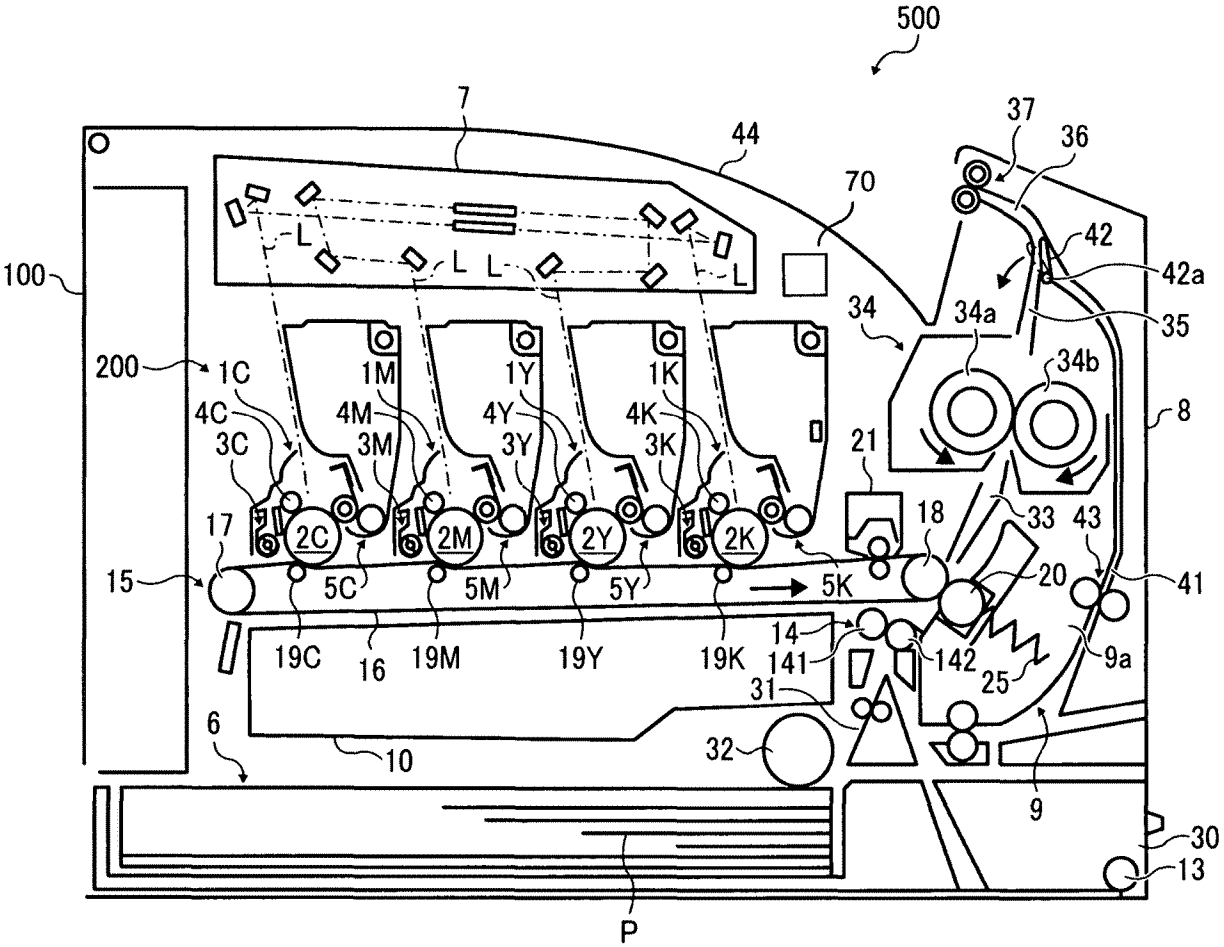
FIG. 2 is a side view illustrating a schematic configuration of the image forming apparatus.

FIG. 1 is a perspective view illustrating an exterior of an image forming apparatus 500 according to an embodiment of this disclosure. FIG. 2 is a side view illustrating a schematic configuration inside the image forming apparatus 500.

It is to be noted that identical parts are given identical reference numerals and redundant descriptions are summarized or omitted accordingly.

The image forming apparatus 500 may be a copier, a facsimile machine, a printer, a multifunction peripheral or a multifunction printer (MFP) having at least one of copying, printing, scanning, facsimile, and plotter functions, or the like. According to the present example, the image forming apparatus 500 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet feeding direction" indicates a direction in which a recording medium travels from an upstream side of a sheet feeding path or a sheet conveying path to a downstream side thereof; the term "width direction" indicates a direction basically perpendicular to the sheet feeding direction or the sheet conveying direction.

As illustrated in FIG. 1, the image forming apparatus 500 includes an apparatus body 100 that accommodates various parts and components used for image formation. A sheet tray 30 that functions as a sheet container accommodating multiple sheets therein is disposed at a lower part of the apparatus body 100. The sheet tray 30 is removably inserted into the apparatus body 100 as illustrated in FIG. 1. The sheet tray 30 can be pulled out toward a front side of the image forming apparatus 500. In FIG. 1, the front side indicates a direction indicated by arrow A. By contrast, a sheet output tray 44 is disposed at an upper part of the apparatus body 100. The sheet output tray 44 functions as a sheet stacker to stack a sheet with a printed image thereon discharged outside the apparatus body 100. Further, a control panel 12 is also disposed at the front side and the upper part of the apparatus body 100. The control panel 12 functions as an input unit through which an operator such as a user operates the image forming apparatus 500. A front cover 8 is disposed at the front side of the apparatus body 100. The front cover 8 functions as a cover to open and close when paper jam occurs inside the apparatus body 100 or when a maintenance is performed. The front cover 8 is removable about a rotary shaft 13 that is disposed at the lower part of the apparatus body 100, as illustrated in FIG. 2, and rotates from the front side toward a direction indicated by arrow B in FIG. 1.

Now, a description is given of a basic configuration of the image forming apparatus 500 in reference to FIG. 2.

As illustrated in FIG. 2, the image forming apparatus includes an image forming device 200 in which four process units 1K, 1Y, 1M, and 1C are aligned as an image forming unit. Suffixes, which are K, Y, M, and C, are used to indicate respective colors of toners (e.g., black, yellow, magenta, and cyan toners) for the process units. The process units 1K, 1Y, 1M, and 1C have substantially the same configuration except for containing different color toners of black (K), yellow (Y), magenta (M), and cyan (C) corresponding to color separation components of a color toner. Therefore, the process units 1K, 1Y, 1M, and 1C and related parts and components are described without suffixes. For example, the process units 1K, 1Y, 1M, and 1C are hereinafter referred to in a singular form occasionally, for example, the "photoconductor 1".

The process unit 1 (i.e., the process units 1K, 1Y, 1M, and 1C) includes a photoconductor 2 (i.e., photoconductors 2K, 2Y, 2M, and 2C), a photoconductor cleaning device 3 (i.e., photoconductor cleaning devices 3K, 3Y, 3M, and 3C), a charging device 4 (i.e., charging devices 4K, 4Y, 4M, and 4C), and a developing device 5 (i.e., developing devices 5K, 5Y, 5M, and 5C). The photoconductor 2 functions as a drum shaped image bearer (a drum shaped latent image bearer) to bear an image on a surface thereof. The photoconductor cleaning device 3 functions as a cleaner to clean the surface of the photoconductor 2. The charging device 4 functions as a charger to uniformly charge the surface of the photoconductor 2. The developing device 5 supplies toner on the surface of the photoconductor 2 so as to form a visible toner image (a developed image). Each process unit 1 is detachably attachable to the apparatus body 100 and consumable parts included in the process unit 1 can be replaced at one time.

As illustrated in FIG. 1, the image forming apparatus 500 further includes an exposure device 7 that is disposed above the process units 1K, 1Y, 1M, and 1C. The exposure device 7 functions as an optical writing device to irradiate respective surfaces of the photoconductors 2K, 2Y, 2M, and 2C. The exposure device 7 emits respective laser light beams L from laser diodes disposed therein based on image data.

The transfer device 15 includes an intermediate transfer belt 16, a driven roller 17, a drive roller 18, four primary transfer rollers 19K, 19Y, 19M, and 19C, a secondary transfer roller 20, and a belt cleaning device 21. The intermediate transfer belt 16 functions as a transfer body having an endless loop onto which the images formed on the photoconductors 2K, 2Y, 2M, and 2C are primarily transferred. The primary transfer rollers 19K, 19Y, 19M, and 19C are disposed facing the photoconductors 2K, 2Y, 2M, and 2C, respectively, with the intermediate transfer belt 16 interposed therebetween, so that respective primary transfer nip regions are formed. The drive roller 18 and the driven roller 17 extend the intermediate transfer belt 16 together with the primary transfer rollers 19K, 19Y, 19M, and 19C. The secondary transfer roller 20 is disposed facing the drive roller 18 with the intermediate transfer belt 16 interposed therebetween, so that a secondary transfer nip region is formed. The belt cleaning device 21 functions as a cleaner to clean the surface of the intermediate transfer belt 16.

A waste toner container 10 is disposed below the transfer device 15. The waste toner container 10 functions as a powder container to store waste toner removed from the intermediate transfer belt 16. In the image forming apparatus 500 according to the present embodiment, it is designed that a sheet feed roller 32 is separated from the secondary transfer roller 20 by a certain distance or gap due to conveyance of a sheet. This separation generates dead space or unused space. By disposing the waste toner container 10 in the dead space, a reduction in overall size of the image forming apparatus 500 is achieved.

A sheet feeding device 6 is disposed below the apparatus body 100 at a lower part of the image forming apparatus 500. The sheet feeding device 6 functions as a sheet feeder to feed the sheet toward the secondary transfer nip region. The sheet feeding device 6 includes the sheet tray 30 and the sheet feed roller 32. The sheet feed roller 32 functions as a sheet feeding body to feed a sheet from the sheet tray 30.

A pair of timing rollers 14 is disposed in a sheet conveying path 31 through which the sheet is conveyed from the sheet feed roller 32 to the secondary transfer nip region. The pair of timing rollers 14 functions as a sheet transfer body to convey the sheet after temporarily stopping the conveyance of the sheet.

Further, a post-transfer sheet conveying path 31 is disposed above the secondary transfer nip region and a fixing device 34 is disposed near the end of the post-transfer sheet conveying path 31. The fixing device 34 fixes the image to the sheet. The fixing device 34 includes a fixing roller 34*a* and a pressure roller 34*b*. The fixing roller 34*a* includes a heat generating source such as a halogen lamp. The pressure roller 34*b* is pressed against the fixing roller 34*a* with a predetermined pressure. The fixing roller 34*a* and the pressure roller 34*b* contacting each other to form a fixing nip region.

A post-fixing sheet conveying path 35 is disposed above the fixing device 34. The post-fixing sheet conveying path 35 branches at a downstream end thereof at its highest position into two paths, which are a sheet ejecting path 36 and a switchback sheet conveying path 41.

A switching member 42 is disposed at the downstream end of the post-fixing sheet conveying path 35. The switching member 42 rotates about a swing shaft 42*a* for switching a conveyance direction of the sheet. The sheet ejecting path 36 communicates with an outside at a downstream end thereof. Further, a pair of sheet output rollers 37 is disposed at the end of the sheet ejecting path 36. The pair of sheet output rollers 37 functions as a sheet output device to eject the sheet to the outside of the apparatus body 100 of the image forming apparatus 500. By contrast, a downstream end of the sheet reversing path 41 meets the sheet conveying path 31, which is an upstream side from the pair of timing rollers 14 in the sheet conveying path 31. Further, a pair of switchback conveying rollers 43 is disposed in the middle of the switchback sheet conveying path 41.

Further, the switchback sheet conveying path 41 is defined by a duplex printing unit 9. The duplex printing unit 9 is disposed rotatable together with the front cover 8 as a single unit. The duplex printing unit 9 includes a sheet conveyance housing 9*a*. The switchback sheet conveying path 41 is arranged at a rear side of the sheet conveyance housing 9*a*. The sheet conveyance housing 9*a* further includes an inner side facing the image forming device 200. The inner side of the sheet conveyance housing 9*a* defines part of sheet conveying paths of the apparatus body 100, for example, the sheet conveying path 31, the post-transfer sheet conveying path 33, and the post-fixing sheet conveying path 35. In addition, the inner side of the sheet conveyance housing 9*a* includes the secondary transfer roller 20 and a timing drive roller 142 that is one roller of the pair of timing rollers 14. Further, a timing driven roller 141 that is the other roller of the pair of timing rollers 14 is disposed on the apparatus body 100.

The secondary transfer roller 20 is generally biased by a compression spring 25 to the intermediate transfer belt 16. However, an image forming apparatus of a full front operation type includes the duplex printing unit 9 that is generally disposed on a near side (a front side) of the intermediate transfer belt 16. Therefore, the size of parts disposed around the compression spring 25 cannot be reduced and the size of the apparatus body 100 can increase in a front and rear direction (a horizontal direction) easily. In order to address this inconvenience, the present embodiment provides a configuration as illustrated in FIG. 2, in which the secondary transfer roller 20 contacts the drive roller 18 from an oblique direction (from a lower right side of FIG. 2) with respect to the horizontal direction. By so doing, the dead space or the unused space can be used effectively, and as a result, the image forming apparatus 500 can be reduced in size in the front and rear direction (the horizontal direction) of the image forming apparatus 500.

Now, referring to FIG. 1, a description is given of basic functions of the image forming apparatus 500 according to an embodiment example of this disclosure, with reference to FIG. 2.

In FIG. 2, as the sheet feed roller 32 starts to rotate in response to a sheet feeding signal issued by a controller 70 of the image forming apparatus 500, an uppermost sheet P placed on top of a bundle of sheets P loaded on the sheet tray 30 is separated from the other sheets of the bundle of sheets and is forwarded into the sheet conveying path 31. On arrival of the leading end of the uppermost sheet P to the nip region of the pair of timing rollers 14, the conveyance of sheets are temporarily stopped. The pair of timing rollers 14 synchronizes movement of a toner image formed on the surface of the intermediate transfer belt 16 At the same time, the pair of timing rollers 14 remains waited in a state in which the sheet P is sagged or slackened in order to correct skew at the leading end of the sheet P.

Now, a description is given of basic image forming operations in a simplex or single-sided printing performed in the image forming apparatus 500 according to an embodiment of this disclosure with reference to FIG. 1. First, the charging device 4 uniformly charges a surface of the photoconductor 2 by supplying a high electric potential at the surface of the photoconductor 2. Based on image data obtained by an image reading device or an external computer, a laser light beam L is emitted from the exposure device 7 to the charged surface of the photoconductor 2, so that the electric potential at the emitted portions on the surface of the photoconductor 2 decreases to form an electrostatic latent image. Then, the developing device 5 supplies toner onto the electrostatic latent image formed on the surface of the photoconductor 2, thus developing (visualizing) the electrostatic latent image into a visible image as a toner image.

Then, the toner image formed on the surface of the photoconductor 2 is transferred onto a surface of the intermediate transfer belt 16 that rotates endlessly. Specifically, when the toner image formed on the surface of the photoconductor 2 arrives a primary transfer nip region, a predetermined transfer voltage is applied to the primary transfer roller 19 to form a transfer electric field. Consequently, the toner image formed on the surface of the photoconductor 2 is transferred onto the surface of the intermediate transfer belt 16. As previously described, the above-described detailed operations are performed in each of the process units 1K, 1Y, 1M, and 1C. For example, respective toner images are developed on the respective surfaces of the photoconductors 2K, 2Y, 2M, and 2C and are then sequentially transferred onto the surface of the intermediate transfer belt 16 to form a composite color toner image. Thus, the intermediate transfer belt 16 bears a full-color toner image on the surface of the intermediate transfer belt 16. The photoconductor cleaning device 3 removes residual toner remaining on the surface of the photoconductor 2 after the primary transfer operation. The residual toner that has removed form the surface of the photoconductor 2 is collected and conveyed to the waste toner container 10 disposed in the process unit 1.

After the respective color toner images have been sequentially transferred in layers onto the surface of the intermediate transfer belt 16 to form the full-color toner image, the pair of timing rollers 14 and the sheet feed roller 32 start rotating, so that the sheet P is conveyed to the secondary transfer nip region at the same timing as (in synchronization with) movement of the full-color toner image transferred and overlaid onto the surface of the intermediate transfer belt 16. At this time, a predetermined transfer voltage is applied to the secondary transfer roller 20. Accordingly, a transfer electric field is formed in the secondary transfer nip region. By the transfer electric field formed at the secondary transfer nip region, the toner image formed on the intermediate transfer belt 16 is collectively transferred onto the sheet P. At this time, the belt cleaning device 21 removes residual toner remaining on the surface of the intermediate transfer belt 16 after the secondary transfer operation. The residual toner that has removed from the surface of the intermediate transfer belt 16 is conveyed to the waste toner container 10 disposed in the process unit 1.

The sheet P on which the transferred toner image is formed passes through the post-transfer sheet conveying path 33 to the fixing device 34. Thereafter, the sheet P is sent into the fixing device 34 and then is held between the fixing roller 34*a* and the pressure roller 34*b*. Thus, the unfixed toner image on the sheet P is fixed to the sheet P by application of heat and pressure. The sheet P with the fixed toner image thereon is conveyed from the fixing device 34 to the post-fixing sheet conveying path 35.

At the timing at which the sheet P is ejected from the fixing device 34, the feeding of the sheet S from the fixing device 34, the switching member 42 is located at the position as illustrated by a solid line in FIG. 2, which allows the sheet P to pass around an open space at the end of the post-fixing sheet conveying path 35. After traveling from the fixing device 34, the sheet P passes through the post-fixing sheet conveying path 35 and the sheet ejecting path 36. Then, the sheet P is held by and passes through the pair of sheet output rollers 37 to be discharged to the sheet output tray 44.

Next, a description is given of a series of basic operations in a duplex or double-sided printing performed in the image forming apparatus 500 according to an embodiment of this disclosure. Similar to the operations of a simplex printing, the sheet P having a fixed image on one side thereof is conveyed from the fixing device 34 to the sheet ejecting path 36. In the duplex printing, as the trailing end of the sheet P that is conveyed by the pair of sheet output rollers 37 passes through the post-fixing sheet conveying path 35, the switching member 42 rotates about the swing shaft 42*a* to a position indicated by a broken line in FIG. 2 to block the passage of the sheet P at and around the end of the post-fixing sheet conveying path 35. Substantially simultaneously, the pair of sheet output rollers 37 rotates in reverse to feed the sheet P in an opposite direction to the switchback sheet conveying path 41.

The sheet P conveyed in the switchback sheet conveying path 41 passes through the pair of switchback conveying rollers 43 and reaches the pair of timing rollers 14. The pair of timing rollers 14 measures optimal timing to transfer the toner image formed on the surface of the intermediate transfer belt 16 onto an unprinted side, i.e., a reverse side of the sheet P in synchronization with movement of the toner image formed on the surface of the intermediate transfer belt 16. When the sheet P passes by the secondary transfer roller 20, the toner image is transferred onto the reverse side of the sheet P on which no image has not yet been formed. In the fixing device 34, the sheet P is held between the fixing roller 34*a* and the pressure roller 34*b* to fix the unfixed toner image formed on the reverse side of the sheet P to the sheet P by application of heat and pressure. The sheet P with the fixed toner image on the reverse side thereof is conveyed through the post-fixing sheet conveying path 35, the sheet ejecting path 36, and the pair of sheet output rollers 37 in this order before ejected to the sheet output tray 44.

Figure 3:
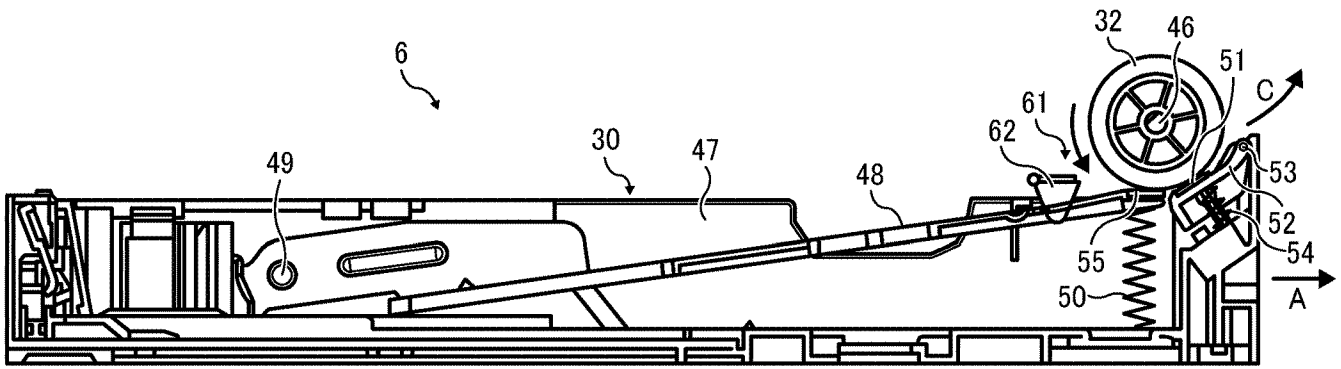
FIG. 3 is a side view illustrating a schematic configuration of a sheet feeding device according to an embodiment of this disclosure.

Now, FIG. 3 is a side view illustrating a schematic configuration of the sheet feeding device 6 according to the present embodiment of this disclosure.

As illustrated in FIG. 3, the sheet feeding device 6 includes the sheet feed roller 32 that is attached to the apparatus body 100 and the sheet tray 30 that is removably inserted to the apparatus body 100.

Figure 4:
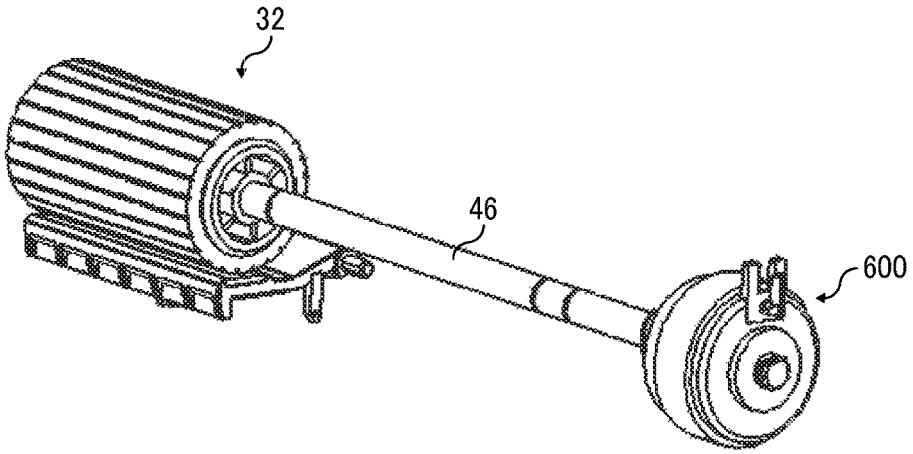
FIG. 4 is a perspective view illustrating an electromagnetic clutch.

The sheet feed roller 32 is attached to a rotary shaft 46 that is rotatably supported by the apparatus body 100 via a bearing and rotation of the sheet feed roller 32 is stopped by a D-cut portion or a pin. A drive gear is attached to the rotary shaft 46 and is connected to a drive source of the apparatus body 100 via drive power transmitters such as multiple idler gears and clutch mechanisms. As a driving force applied by the drive source is transmitted to the drive gear, the sheet feed roller 32 is driven to rotate in a counterclockwise direction in FIG. 3. A surface (an outer circumferential surface) of the sheet feed roller 32 includes a material having high coefficient of friction such as rubber. As the sheet feed roller 32 rotates, the sheet P is conveyed by a friction force that is generated between the sheet feed roller 32 and the sheet P in a direction indicated by arrow C in FIG. 3. Further, a connection time of a drive connector is controlled, and therefore an intermittent sheet feeding process in which the sheet feed roller 32 is driven or stopped at a predetermined timing can be performed. In the present embodiment, in order to perform the intermittent sheet feeding process of the sheet feed roller 32, an electromagnetic clutch 600 that functions as a drive power transmitter (see FIG. 4) is used to transmit or block the driving force applied by the drive source to the sheet feed roller 32.

The sheet tray 30 includes a tray body 47 and a bottom plate 48. The tray body 47 is formed in a flat box shape with an upper face thereof is open. The bottom plate 48 that functions as a sheet loader on which sheets accommodated in the tray body 47. The tray body 47 is detachably attached to the apparatus body 100 in a direction indicated by arrow A in FIG. 3.

It is to be noted that FIG. 3 depicts a state in which the tray body 47 is inserted and set in the apparatus body 100.

The bottom plate 48 is disposed to be rotatable about a support shaft 49 that is mounted on the tray body 47. To be more specific, in the present embodiment, an upstream end of the bottom plate 48 in a sheet feeding direction indicated by arrow C in FIG. 3 is rotatably supported by the support shaft 49 that extend in a sheet width direction. By rotating the bottom plate 48 about the support shaft 49, a downstream end of the bottom plate 48 in the sheet feeding direction C can be rotated or swung in a vertical direction, in other words, upwardly and downwardly. Further, the bottom plate 48 is biased in an upward direction by a bottom plate spring 50 that functions as a biasing member.

A separation pad 51 that functions as a first sheet separator is disposed at a downstream side in the sheet feeding direction C. The separation pad 51 separates the sheets P to be fed one by one from the sheet tray 30. The separation pad 51 includes a frictional material having high coefficient of friction such as urethane foam rubber, ethylene propylene rubber (EP rubber), silicone rubber, cork, and compounding materials of these frictional materials. In addition, the separation pad 51 is attached on an upper face of a pad receiving table 52 that functions as a separator retainer by a double-sided adhesive tape, for example.

A downstream end of the pad receiving table 52 in the sheet feeding direction C is rotatably supported by a support shaft 53. The support shaft 53 is mounted on the tray body 47 extending in the sheet width direction. As the pad receiving table 52 rotates about the support shaft 53, the separation pad 51 that is retained to an upper face at the upstream end of the pad receiving table 52 in the sheet feeding direction C changes the position toward a direction to approach and separate from the outer circumferential surface of the sheet feed roller 32. Further, the pad receiving table 52 is biased in the upward direction by a receiving table spring 54 that functions as a biasing member. Accordingly, in a state illustrated in FIG. 3, the separation pad 51 is retained by the biasing force applied by the receiving table spring 54 while contacting the outer circumferential surface of the sheet feed roller 32. In the present embodiment, the pad receiving table 52 rotates about the support shaft 53. However, the configuration is not limited thereto. For example, a configuration in which pad receiving table 52 is movable in a straight direction can be applied to this disclosure, so that the separation pad 51 can approach and separate from the sheet feed roller 32.

A loading face pad 55 is disposed at a downstream end in the sheet feeding direction C of a sheet loading face (an upper face) on which the sheets P on the bottom plate 48. The loading face pad 55 that functions as a second separator includes a material having high coefficient of friction such as cork. As illustrated in FIG. 3, when no sheet is loaded on the bottom plate 48, the bottom plate 48 is biased by the bottom plate spring 50. Accordingly, the loading face pad 55 is retained while contacting the outer circumferential surface of the sheet feed roller 32.

It is to be noted that the bottom plate 48 can also function as a separator retainer to retain the loading face pad 55. In the present embodiment, the bottom plate 48 rotates about the support shaft 49 so that the loading face pad 55 moves to approach or separate with respect to the sheet feed roller 32. However, the configuration is not limited thereto. For example, a configuration in which the bottom plate 48 is movable in a straight direction (in a vertical direction) can be applied to this disclosure.

Further, a loaded sheet detector 61 is disposed at a position facing the bottom plate 48. The loaded sheet detector 61 detects whether or not the sheet P is loaded on the bottom plate 48. The loaded sheet detector 61 includes a sheet loading feeler 62 that is disposed swingably and an optical sensor to detect movement of the sheet loading feeler 62. When the sheet P or a bundle of sheets P is loaded on the bottom plate 48, the sheet loading feeler 62 is in contact with an upper face of an uppermost sheet P that is placed on top of the bundle of sheets. When the sheet loading feeler 62 blocks a light path in which light emitted from a light emitting part to a light receiving part of the optical sensor travels at this position, presence of the sheet P or the bundle of sheets P (i.e., a state in which the sheet P or the bundle of sheets P is loaded on the bottom plate 48 is detected. By contrast, when no sheet P is loaded on the bottom plate 48, the sheet loading feeler 62 enters in an opening on the bottom plate 48. Accordingly, the light emitted from the light receiving part is received by the light receiving part, and therefore absence of the sheet P or the bundle of sheets P (i.e., a state in which no sheet is loaded on the bottom plate 48 is loaded on the bottom plate 48) is detected.

Figure 5:
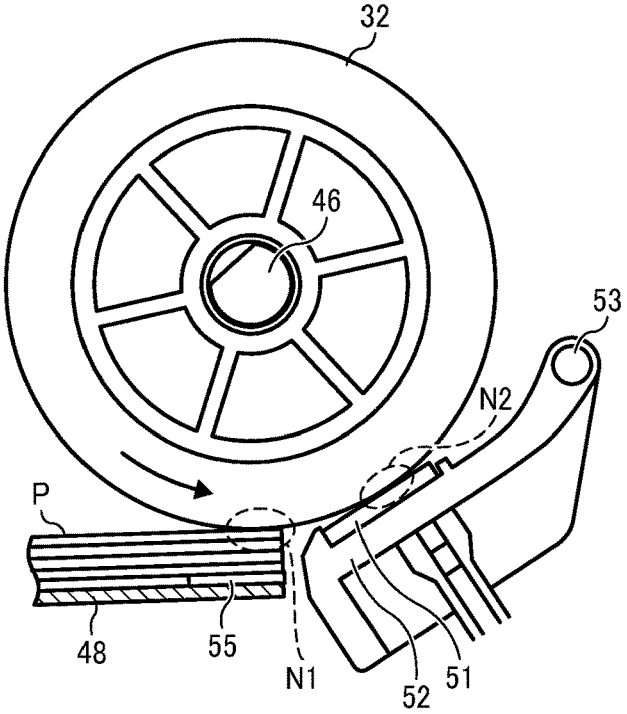
FIG. 5 is a diagram illustrating the sheet feeding device in a state in which sheets are loaded on a bottom plate.

FIG. 5 is a diagram illustrating the sheet feeding device 6 in a state in which the bundle of sheets P are loaded on the bottom plate 48.

As the sheet feed roller 32 is rotated in a direction indicated by arrow illustrated in FIG. 5, an uppermost sheet P that is placed on top of the bundle of sheets P is fed forward. Thereafter, the same operation as the above-described sheet feeding operation performed on the uppermost sheet P and the subsequent sheet P is repeated, so that the upper sheet P is separated from the lower sheet P and fed forward one by one. When two sheets P are left on the bottom plate 48 and the upper sheet P is separated from the lower sheet P that is a lowermost sheet P and fed forward, the lowermost sheet P is stopped in the nip region N1 due to friction with the loading face pad 55. Accordingly, the upper sheet P is separated and fed forward.

Generally, in a sheet feeder having a pad-type sheet separator, when a first sheet is fed, for example, after a new bundle of sheets is set in a sheet feeder, vibration is generated between a sheet feed roller and a sheet separation pad, resulting in generation of noise. For example, as illustrated in FIG. 5, when feeding the first sheet P that is the uppermost sheet P placed on top of the bundle of sheets P loaded on the bottom plate 48, no sheet is held in the nip region N2 between the sheet feed roller 32 and the separation pad 51. That is, the sheet feed roller 32 contacts the separation pad 51 directly or without any sheets P interposed therebetween. Therefore, as the sheet feed roller 32 rotates, a large load is applied to the sheet feed roller 32 in the nip region N2 due to friction with the separation pad 51. As a result, the load causes vibration to be generated to the separation pad 51 and the pad receiving table 52 that holds the separation pad 51 and to be transmitted to parts disposed around the sheet feed roller 32 while increasing the vibration. Even if this vibration occurs at a constant speed of rotation, as the rotation of the sheet feed roller 32 continues, the degree of vibration increases. Then, when the degree of vibration reaches at a certain level, noise is generated.

Figure 6:
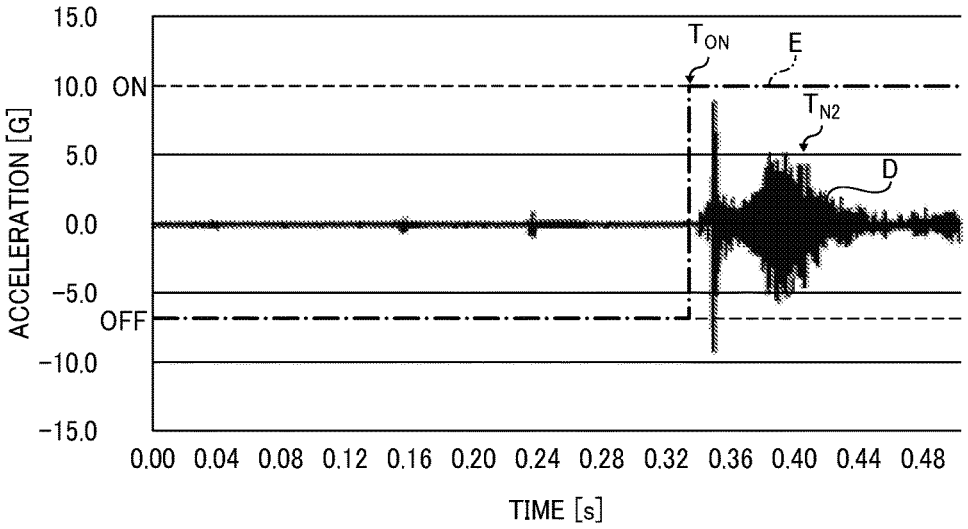
FIG. 6 is a graph of waves of vibration generated in a comparative sheet feeding device.

FIG. 6 is a graph of waves of vibration generated in a comparative sheet feeding device.

In FIG. 6, a solid line D indicates waves of vibration generated in the pad receiving table 52 and a vertical axis indicates the degrees of the waves of vibration (acceleration [G]). A broken line E indicates current value that flows in the electromagnetic clutch 600 that transmits the driving force to the sheet feed roller 32. At a timing ($T_{ON}$) when the current value is increased, the sheet feed roller 32 starts driving. A horizontal axis indicates time [s].

As shown in the graph of FIG. 6, after the electromagnetic clutch 600 has turned on to start driving the sheet feed roller 32, vibration generated on the pad receiving table 52 gradually increases. Specifically, vibration starts increasing when the sheet P is fed by the sheet feed roller 32 and continues to increase up to a timing $T_{N2}$ at which the leading end of the sheet P reaches the nip region N2 (hereinafter, referred to as a "separation nip region N2") formed between the sheet feed roller 32 and the separation pad 51. Thereafter, the vibration continues to decrease.

As described above, vibration generated in the pad receiving table 52 due to rotation of the sheet feed roller 32 increases as the rotation of the sheet feed roller 32 continues. However, the vibration does not reach the peak immediate after the sheet feed roller 32 starts rotation. Further, it was found that noise does not occur when the amount of vibration is not so large. Accordingly, even when vibration occurs, if an increase in vibration can be restrained, occurrence of noise can be prevented. Based on the above-described findings, the sheet feeding device 6 according to the present embodiment of this disclosure has the following configuration.

Figure 7:
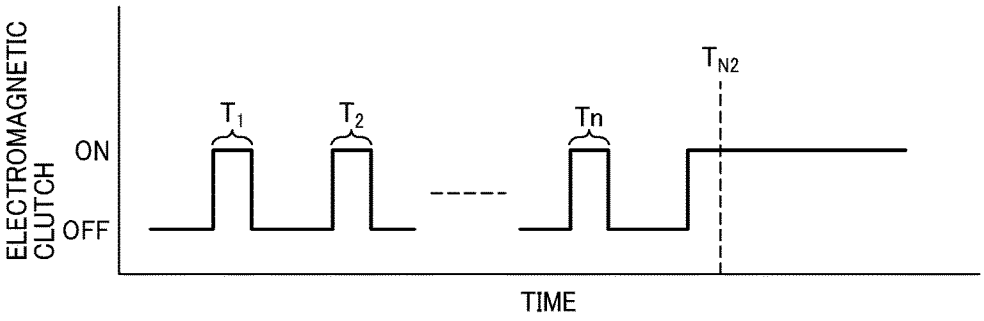
FIG. 7 is a timing chart of ON and OFF of an electromagnetic clutch according to the present embodiment of this disclosure.

FIG. 7 is a timing chart showing the power ON and OFF of the electromagnetic clutch 600 according to the present embodiment of this disclosure.

As illustrated in FIG. 7, in the configuration of the sheet feeding device 6 according to the present embodiment, when the first sheet P is fed in a state in which the sheet P does not reside in the separation nip region N2 and the sheet feed roller 32 and the separation pad 51 contact each other directly, the electromagnetic clutch 600 is turned ON intermittently before the leading end of the first sheet P reaches the separation nip region N2 (until the timing $T_{N2}$ in FIG. 7). By so doing, a unit time per turning ON of the electromagnetic clutch 600 (respective times $T_1$, $T_2$, . . . Tn) is reduced. Consequently, after the leading end of the first sheet P has reached the separation nip region N2, the electromagnetic clutch 600 is turned ON continuously. It is to be noted that, in the present embodiment, whether or not the leading end of the sheet P has reached the separation nip region N2 is determined based on a distance from a sheet feeding start position of the sheet P (i.e., the position where the sheet P is loaded on the bottom plate 48) to the separation nip region N2 and a distance of travel of the sheet P per intermittent rotation of the sheet feed roller 32.

Thus, the electromagnetic clutch 600 is intermittently turned ON until the first sheet P reaches the separation nip region N2 to reduce the unit time per turning ON of the electromagnetic clutch 600. By so doing, an increase in vibration generated by continuous rotation of the sheet feed roller 32 in the state in which the sheet feed roller 32 is directly in contact with the separation pad 51 can be restrained. That is, the sheet feed roller 32 is stopped driving temporarily before vibration increases to generate noise, and the rotation of the sheet feed roller 32 is started again to prevent occurrence of noise.

Figure 8:
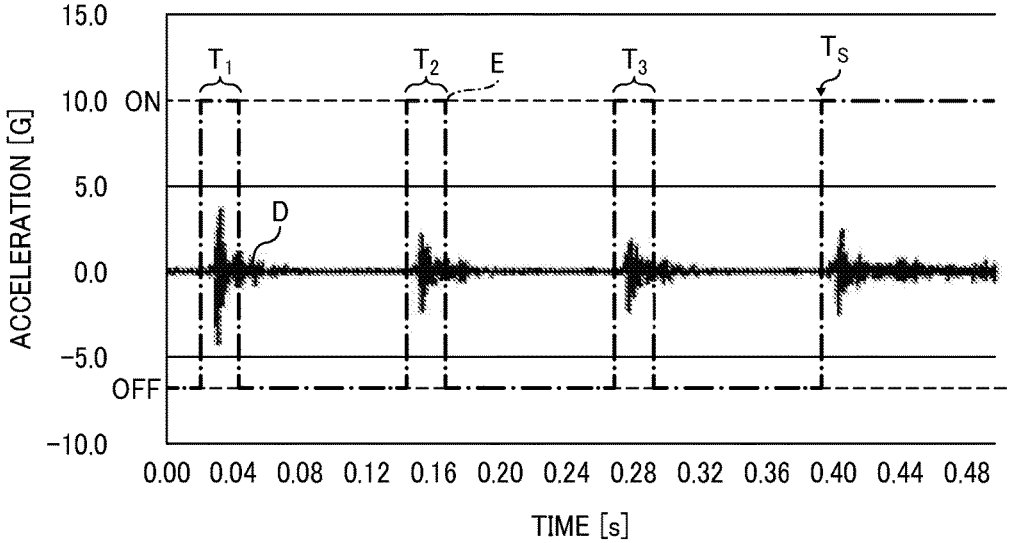
FIG. 8 is a graph of waves of vibration generated in the sheet feeding device according to the present embodiment of this disclosure.

FIG. 8 is a graph of waves of vibration generated in the sheet feeding device 6 according to the present embodiment of this disclosure.

Similar to the description with reference to FIG. 6, the solid line D indicates waves of vibration generated in the pad receiving table 52 and a vertical axis indicates the degrees of the waves of vibration (acceleration [G]). The broken line E indicates current value that flows in the electromagnetic clutch 600 that transmits the driving force to the sheet feed roller 32.

As illustrated in FIG. 8, in the present embodiment, the electromagnetic clutch 600 is intermittently turned ON until the leading end of the first sheet P reaches the separation nip region N2 to reduce a unit time per turning ON of the electromagnetic clutch 600. By so doing, an increase in vibration generated by continuous rotation of the sheet feed roller 32 can be restrained. Specifically, the degree of vibration was about 10 [G] and the continuous time of vibration was 0.1 [s] in the example described with reference to FIG. 6. By contrast, the degree of vibration (at $T_1$, $T_2$, and $T_3$) when the electromagnetic clutch 600 is turned ON intermittently is reduced to about 3.5 [G] and the continuous time of vibration is reduced to 0.025 [s] in the present embodiment.

As described above, an increase in vibration can be restrained by reducing the time of the turn ON of the electromagnetic clutch 600. However, if the time of turning ON of the electromagnetic clutch 600, the number of turning OFF increases. Consequently, an average speed of conveyance is reduced, and therefore the productivity is lowered. Therefore, in the present embodiment, the productivity is considered. Accordingly, when the electromagnetic clutch 600 is turned ON intermittently, the number of repeats of turning ON and OFF of the electromagnetic clutch 600 is set to 3, the time of turning ON of the electromagnetic clutch 600 is set to 0.025 [s], and the time of turning OFF of the electromagnetic clutch 600 is set to 0.1 [s]. However, these values are not limited thereto and can be determined according to the length of a sheet conveying path, the productivity of an image forming apparatus, and a first print time.

Further, after the electromagnetic clutch 600 is turned ON intermittently (after the timing Ts) in FIG. 8, regardless of continuous turning ON of the electromagnetic clutch 600, the degree of vibration is restrained to about 2.0 [G]. Since the leading end of the sheet P had reached the separation nip region N2, a large load was not applied between the sheet feed roller 32 and the separation pad 51, and the degree of vibration did not increase. Therefore, the degree of vibration is restrained. Consequently, after the leading end of the sheet P has reached the separation nip region N2, even if the electromagnetic clutch 600 is not turned ON intermittently, the degree of vibration does not increase largely. Therefore, the electromagnetic clutch 600 is not turned ON intermittently. Accordingly, as described in the present embodiment, after the leading end of the sheet P has reached the separation nip region N2, the electromagnetic clutch 600 is not turned ON intermittently (i.e., is turned ON continuously). Consequently, a reduction in productivity and a reduction in service life of the electromagnetic clutch 600 can be prevented.

Further, as described in the present embodiment, a clutch mechanism such as the electromagnetic clutch 600 is used to connect the drive source and the sheet feed roller 32. By so doing, even if the drive source of the sheet feed roller 32 is shared with a different device, the driving of the sheet feed roller 32 does not adversely affect on the different device and the sheet feed roller 32 can be driven independently. With this configuration, a drive source can be shared, and therefore a reduction in size of the device and a reduction in cost of the device can be achieved. It is to be noted that, in the present embodiment, the driving force is transmitted from the drive source to the sheet feed roller 32 or is blocked by using the electromagnetic clutch 600, but not limited thereto. For example, any other drive power transmitters such as a solenoid can be used instead of the electromagnetic clutch 600.

Now, a description is given of operation conditions of a sheet feeding operation in an intermittent sheet feeding mode in which the electromagnetic clutch 600 is intermittently turned on when feeding a first sheet of the bundle of sheets accommodated in the sheet tray 30.

Figure 9:
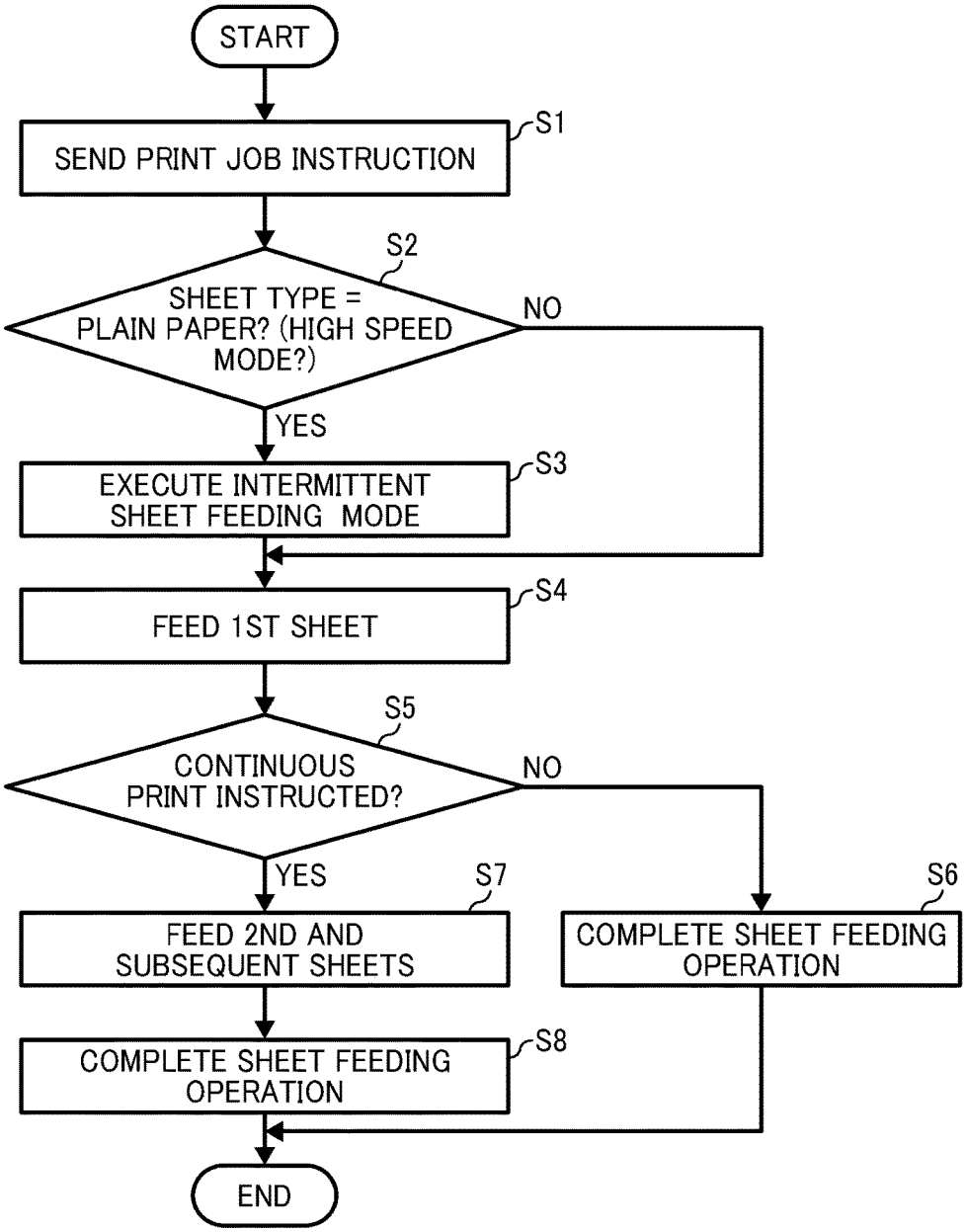
FIG. 9 is a flowchart of a sheet feeding operation according to the present embodiment of this disclosure.

FIG. 9 is a flowchart of a sheet feeding operation according to the present embodiment of this disclosure. The flowchart of FIG. 9 shows procedures to determine whether or not the intermittent sheet feeding mode is performed according to a sheet feeding speed that is set based on a sheet type (e.g., material, thickness, etc.). A high speed mode to feed sheets at high speed and a low speed mode to feed sheets at speed slower than the speed in the high speed mode are previously determined. The high speed mode is selected when feeding plain paper, thin paper, and recycled paper (hereinafter, referred to as a "plain paper type") and the low speed mode is selected when feeding thick paper.

It is to be noted that the "high speed mode" and the "low speed mode" described in the present embodiment are defined by a distance of relative sheet feeding speeds of these modes, and not limited thereto. For example, a "regular speed mode" and a "low speed mode" that is a sheet feeding speed slower than the regular speed mode are also applicable to this disclosure.

As the sheet feeding speed (i.e., the speed of rotation of the sheet feed roller 32) increases, a sliding load between the sheet feed roller 32 and the separation pad 51 also increases. Therefore, when the sheet feeding operation is performed in the high speed mode, noise or abnormal sound due to vibration can occur easily in the above-described sheet feeding operation. By contrast, when the sheet feeding operation is performed in the low speed mode, noise or abnormal sound due to vibration is less likely to occur.

Accordingly, as illustrated in the flowchart of FIG. 9, after a print job instruction is sent in step S1, it is determined whether or not a sheet selected in the image forming apparatus 500 is a plain paper, that is, whether or not a print mode is the high speed mode in step S2. As a result, when the plain paper (the high speed mode) is selected (YES in step S2), the intermittent sheet feeding mode is performed when feeding the first sheet, in step S3. Then, the sheet feeding operation is performed, in step S4. It is to be noted that no sheet is held between the sheet feed roller 32 and the separation pad 51 when feeding the first sheet here. Hereinafter, the same condition is applied when feeding the first sheet. Accordingly, by executing the intermittent sheet feeding mode when the first sheet is fed without any sheet interposed between the sheet feed roller 32 and the separation pad 51, an increase in vibration that occurs in the sheet feeding operation, and therefore occurrence of noise can be prevented.

By contrast, when the thick paper (the low speed mode) is selected (NO in step S2), noise and abnormal sound caused by vibration is less likely to occur easily. Therefore, the procedure goes to step S4, in which the first sheet is fed in a low speed mode that is previously set, without performing step S3, i.e., the intermittent sheet feeding mode is not selected. In the low speed mode, the sheet is continuously set from a sheet feeding start position.

Then, it is determined whether or not the above-described print job instruction indicates a continuous printing of multiple sheets in the image forming apparatus 500, in step S5. As a result, when the print job instruction indicates a printing of one sheet (NO in step S5), the sheet conveying operation completes, in step S6.

By contrast, when the print job instruction indicates the continuous printing of multiple sheets (YES in step S5), the second and subsequent sheets are fed. Since the sheet P is held in the separation nip region N2, a large load is not applied to an area between the sheet feed roller 32 and the separation pad 51, and therefore vibration generated between the sheet feed roller 32 and the separation pad 51 does not increase. Accordingly, the second and subsequent sheets are fed not in the intermittent sheet feeding mode but in the selected sheet feeding mode, in step S7.

Then, when the last sheet is fed, the sheet feeding operation is completed, in step S8.

As described above in the flowchart of FIG. 9, according to the sheet type or the setting of the sheet feeding speed based on the sheet type, when noise generated due to vibration occurs easily, the intermittent sheet feeding mode is executed when feeding the first sheet. By so doing, occurrence of noise can be prevented. Further, the intermittent sheet feeding mode is selectively executed when the first sheet that is a plain paper is fed, in other words, when the first sheet is fed in the high speed mode. That is, the intermittent sheet feeding mode is not executed in any other cases. Accordingly, deterioration in productivity of image formation and a reduction in service life of the electromagnetic clutch 600 can be prevented.

It is to be noted that the above-described sheet feeding operation according to the present embodiment includes two modes, which are the high speed mode and the low speed mode. However, the sheet feed mode is not limited thereto. For example, a sheet feeding operation may include three modes such as a high speed mode, a low speed mode, and an intermediate speed mode. Alternatively, a sheet feeding operation may include four or more modes. Further, a determination whether or not to execute the intermittent sheet feeding mode when feeding the first sheet may be made after consideration of the speed of each mode and of possibility of occurrence of noise. For example, if three speed modes are applicable to the print job, the intermittent sheet feeding mode may be executed in the high speed mode or in either of the high speed mode and the intermediate speed mode. For example, if three speed modes are applicable to the print job, the intermittent sheet feeding mode may be executed in the high speed mode or in either of the high speed mode and the intermediate speed mode. Further, the above-described sheet feeding operation according to the present embodiment executes the intermittent sheet feeding mode after the print job instruction is sent. However, the intermittent sheet feeding mode may be executed in a standby state and sheets may be fed in increments.

Figure 10:
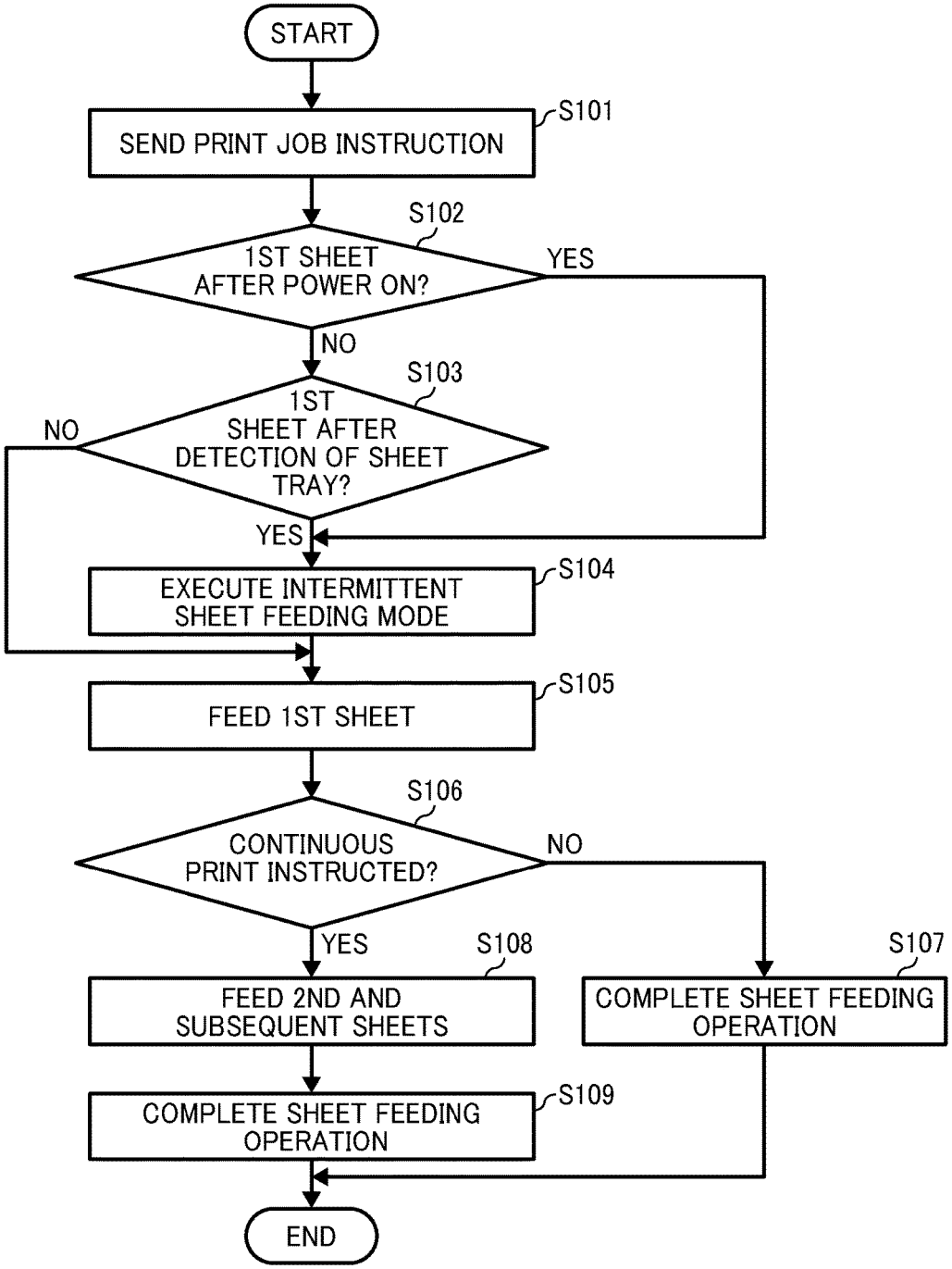
FIG. 10 is a flowchart of another sheet feeding operation according to the present embodiment of this disclosure.

FIG. 10 is a flowchart of another sheet feeding operation according to the present embodiment of this disclosure.

As shown in the flowchart of FIG. 10, whether or not to execute the intermittent sheet feeding mode is determined according to a power ON/OFF of the image forming apparatus 500 and attachment and detachment of the sheet tray 30 with respect to the apparatus body 100. Specifically, after a print job instruction is sent in step S101, it is determined whether or not it is the first sheet to be fed after the image forming apparatus 500 is powered on, in step S102. When it is the first sheet to be fed after the image forming apparatus 500 is powered on (YES in step S102), the procedure goes to step S104 to execute the intermittent sheet feeding mode. When it is not the first sheet to be fed after the image forming apparatus 500 is powered on (NO in step S102), the procedure goes to step S103. In step S103, it is determined whether or not it is the first sheet to be fed after attachment of the sheet tray 30 to the apparatus body 100 is detected. When it is the first sheet to be fed after attachment of the sheet tray 30 is detected (YES in step S103), the intermittent sheet feeding mode is executed when feeding the first sheet, in step S104. Thereafter, the sheet feeding operation performed in steps S105 through S109 that are the same operations as steps S4 through S8, respectively, in the flowchart of FIG. 9. Therefore, the detailed description of the sheet feeding operation in these steps in the flowchart of FIG. 10 is omitted here.

The above-described noise generated by vibration may occur when the first sheet P is fed under a condition in which no sheet is held between the sheet feed roller 32 and the separation pad 51. This inconvenience may cause, for one reason, after a sheet refilling operation in which the sheet tray 30 is pulled out from the apparatus body 100 to refill the sheet tray 30 with the sheets P and then attached to the apparatus body 100 again. Whether or not the sheet tray 30 is attached to the apparatus body 100 is detected by a sensor mounted on the apparatus body 100. When the sensor detects the attachment of the sheet tray 30, the intermittent sheet feeding mode is executed when feeding the first sheet. By so doing, noise that can occur at the timing of feeding the first sheet can be prevented.

However, the sensor detects the attachment of the sheet tray 30 when the image forming apparatus 500 is powered on. That is, when the image forming apparatus 500 is not powered on and remains turned off, even if the sheet tray 30 is attached to the apparatus body 100, the sensor cannot detect the attachment of the sheets P. In the flowchart of FIG. 10, even when the image forming apparatus 500 is powered on, by executing the intermittent sheet feeding mode when feeding the first sheet, occurrence of noise caused by attachment of the sheet tray 30 during the power off of the image forming apparatus 500 can be prevented.

By contrast, when feeding the first sheet at a timing other than when the image forming apparatus 500 is powered on and when the attachment of the sheet tray 30 is detected, the sheet P is generally held between the sheet feed roller 32 and the separation pad 51 due to the sheet feeding operation that has been performed in response to the previous print job instruction. In such a case, even if the intermittent sheet feeding mode is not executed, vibration does not relatively increase. Therefore, the first sheet is fed in a regular sheet feeding mode without executing the intermittent sheet feeding mode. Further, the sheet P is held between the sheet feed roller 32 and the separation pad 51 when feeding the second and subsequent sheets. Therefore, similar to the above-described flowcharts of FIGS. 9 and 10, the sheets are fed in the regular sheet feeding mode without executing the intermittent sheet feeding mode. Accordingly, deterioration in productivity of image formation and a reduction in service life of the electromagnetic clutch 600 can be prevented.

Figure 11:
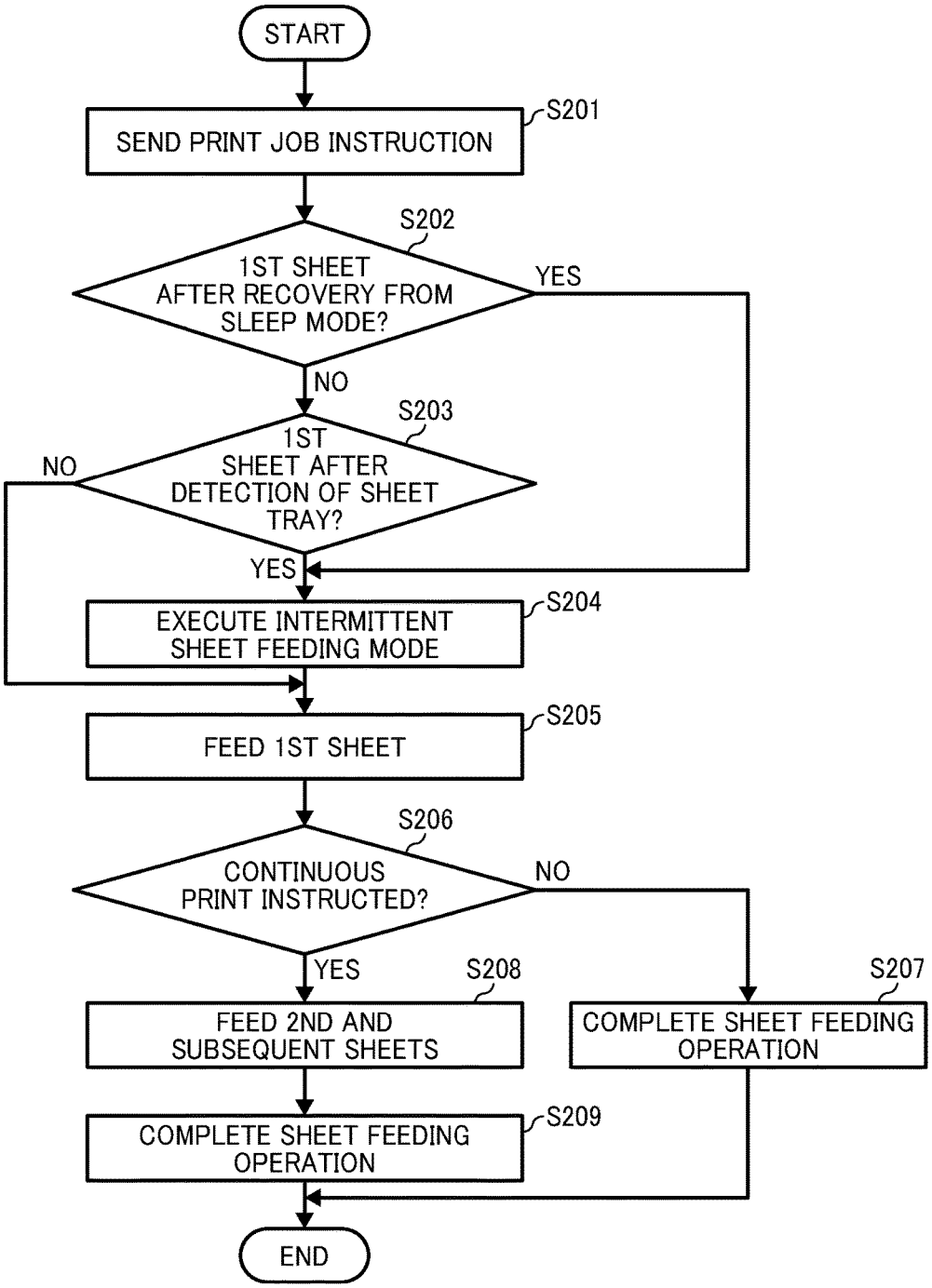
FIG. 11 is a flowchart of yet another sheet feeding operation according to the present embodiment of this disclosure.

In recent years, for the purpose of energy saving, a sleep mode that is a lower power mode is widely employed. In the sleep mode, the electric power supply to selected sections of the configuration of the image forming apparatus is stopped in a case in which any image data has not been received for a predetermined time. In the configuration in which the sleep mode is employed, if the sheet tray 30 is attached in the sleep mode, the sensor cannot detect the attachment of the sheet tray 30. FIG. 11 is a flowchart of yet another sheet feeding operation according to present embodiment of this disclosure. In this case, as shown in the flowchart of FIG. 11, after recovery form the sleep mode (step S202), the intermittent sheet feeding mode is executed when feeding the first sheet (step S204). By so doing, occurrence of noise due to attachment of the sheet tray 30 in the sleep mode can be prevented. It is to be noted that, in the flowchart of FIG. 11, after a print job instruction is sent in step S201, it is determined whether or not the first sheet is fed after the recovery from the sleep mode, in step S202, instead of confirmation of the power on of the image forming apparatus 500. Other than the procedure of step S202, the sheet feeding operation performed in steps S201 and S203 through S209 are the same operations as steps S1 and S4 through S8, respectively, in the flowchart of FIG. 9. Therefore, the detailed description of the sheet feeding operation in these steps in the flowchart of FIG. 11 is omitted here.

Figure 12:
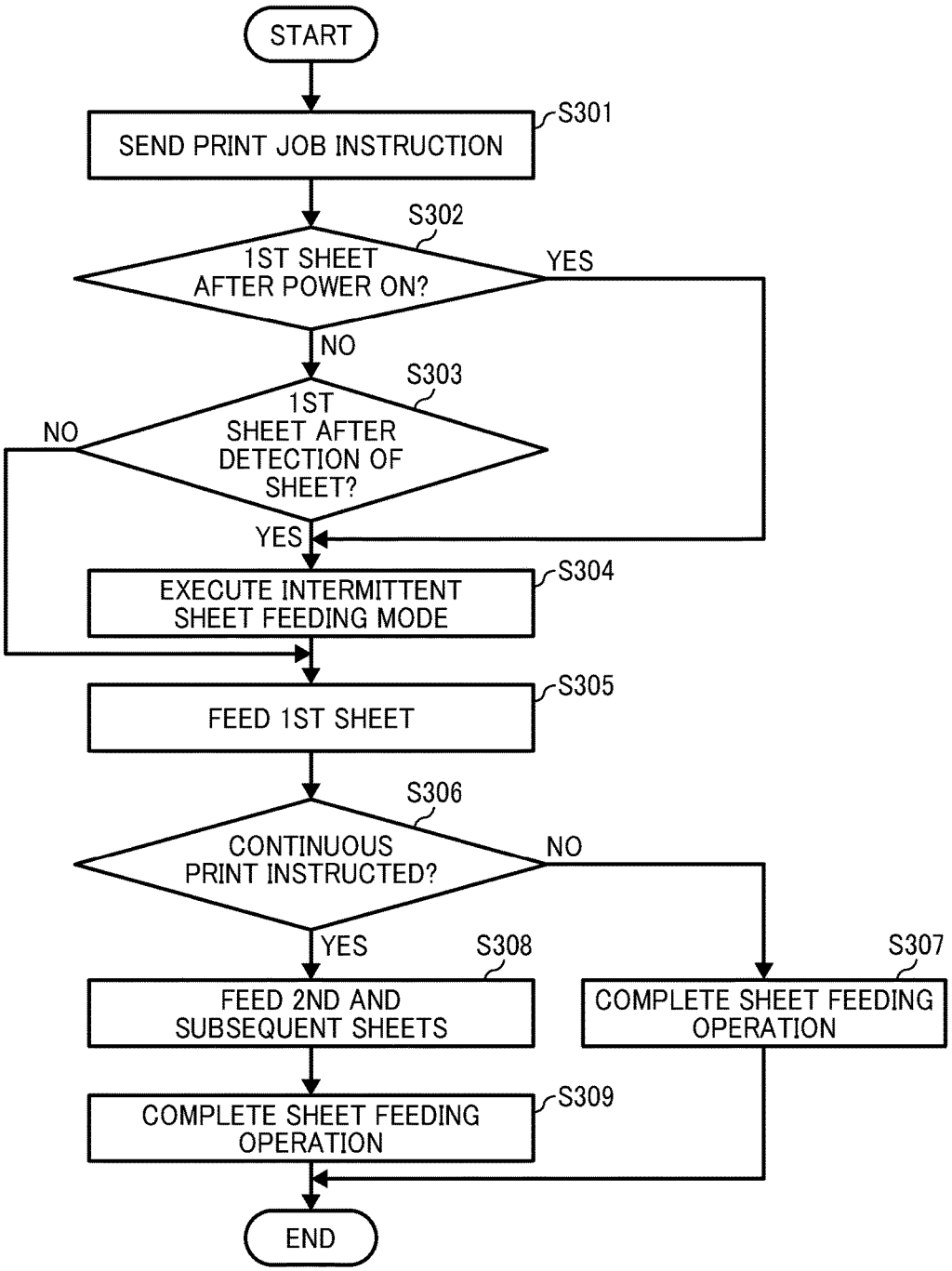
FIG. 12 is a flowchart of yet another sheet feeding operation according to the present embodiment of this disclosure.
Figure 13:
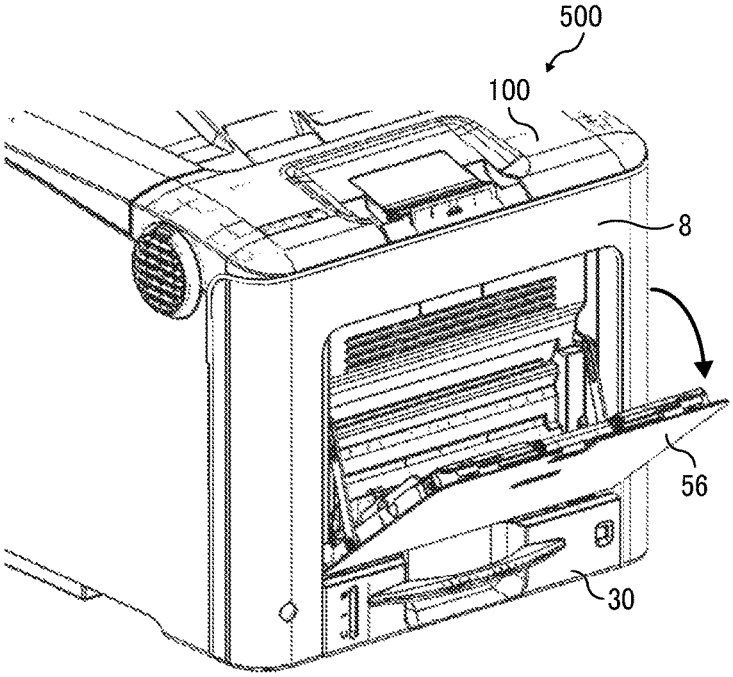
FIG. 13 is a perspective view illustrating another sheet feeding device including a bypass tray.

FIG. 12 is a flowchart of yet another sheet feeding operation according to the present embodiment of this disclosure. FIG. 13 is a perspective view illustrating another sheet feeding device including a bypass tray 56. The flowchart of FIG. 12 shows a sheet feeding operation with the bypass tray 56 in addition to the sheet tray 30. The bypass tray 56 functions as a sheet loader on which the sheet P is loaded.

The bypass tray 56 is switchable between a closed state in which the bypass tray 56 is arranged on the same plane with a side face of the apparatus body 100 and an open state in which the bypass tray 56 is separated from the side face of the apparatus body 100 to open.

As illustrated in FIG. 13, the sheet P is loaded on the bypass tray 56 in the open state and can be fed by a bypass sheet feed roller that is disposed downstream from the bypass tray 56 in the sheet feeding direction. Further, the sheet P that is fed from the bypass tray 56 can be separated one by one by a separation pad disposed facing the bypass sheet feed roller and conveyed further, for example, toward the image forming device 200. The respective configurations of the separation pad and the bypass sheet feed roller are basically identical to those of the separation pad 51 and the sheet feed roller 32 included in the sheet feeding device 6. Therefore, if the first sheet is fed in a state in which no sheet is held between the bypass sheet feed roller and the separation pad, similar noise or abnormal sound may occur.

Here, in the sheet feeding device including the bypass tray 56, no sheet is held between the bypass sheet feed roller and the separation pad when a sheet P is set or reset on the bypass tray 56. Whether or not the sheet P is set or reset on the bypass tray 56 is determined by detection of a sensor mounted on the apparatus body 100. That is, if the sensor detects absence of sheet once and then detects presence of sheet, it is determined that the sheet P is set on the bypass tray 56.

Accordingly, as illustrated in FIG. 12, after a print job instruction is sent in step S301, it is determined whether or not it is the first sheet to be fed after the image forming apparatus 500 is powered on, in step S5302. When it is the first sheet to be fed after the image forming apparatus 500 is powered on (YES in step S302), the procedure goes to step S304 to execute the intermittent sheet feeding mode. When it is not the first sheet to be fed after the image forming apparatus 500 is powered on (NO in step S302), the procedure goes to step S303. In step S303, it is determined whether or not it is the first sheet to be fed after the sensor has detected presence of sheet on the bypass tray 56. When it is not the first sheet to be fed after the sensor has detected presence of sheet on the bypass tray 56 (NO in step S303), the sheet feeding operation is performed, in step S305. By contrast, when it is the first sheet to be fed after the sensor has detected presence of sheet on the bypass tray 56 (YES in step S303), the intermittent sheet feeding mode is executed when feeding the first sheet, in step S304. Accordingly, the sheet feeding operation shown in the flowchart of FIG. 12 can prevent occurrence of noise that may occur at this time. However, when the image forming apparatus 500 is not powered on and remains turned off, if the sheet P on the bypass tray 56 is reset, the sensor cannot detect the presence of the sheets P. In order to address this inconvenience, in addition to the case in which the sensor has detected presence of sheet, when it is detected that the image forming apparatus 500 is powered on (step S302), the intermittent sheet feeding mode is executed when feeding the first sheet. By so doing, occurrence of noise due to reset of the sheet on the bypass tray 56 during the power off of the image forming apparatus 500 can be prevented. It is to be noted that, in the flowchart of FIG. 12, the sheet feeding operation performed in steps S305 through S309 are the same operations as steps S4 through S8, respectively, in the flowchart of FIG. 9. Therefore, the detailed description of the sheet feeding operation in these steps in the flowchart of FIG. 12 is omitted here.

By contrast, when feeding the first sheet at a timing other than when the image forming apparatus 500 is powered on and when the presence of sheet on the bypass tray 56 is detected, the sheet P is generally held between the bypass sheet feed roller and the separation pad due to the sheet feeding operation that has been performed in response to the previous print job instruction. Therefore, the first sheet is fed in a regular sheet feeding mode. Further, the sheet P is held between the bypass sheet feed roller and the separation pad when feeding the second and subsequent sheets. Therefore, similar to the above-described flowcharts of FIGS. 9 through 11, the sheets are fed in the regular sheet feeding mode without executing the intermittent sheet feeding mode. Accordingly, deterioration in productivity of image formation and a reduction in service life of the electromagnetic clutch 600 can be prevented.

Figure 14:
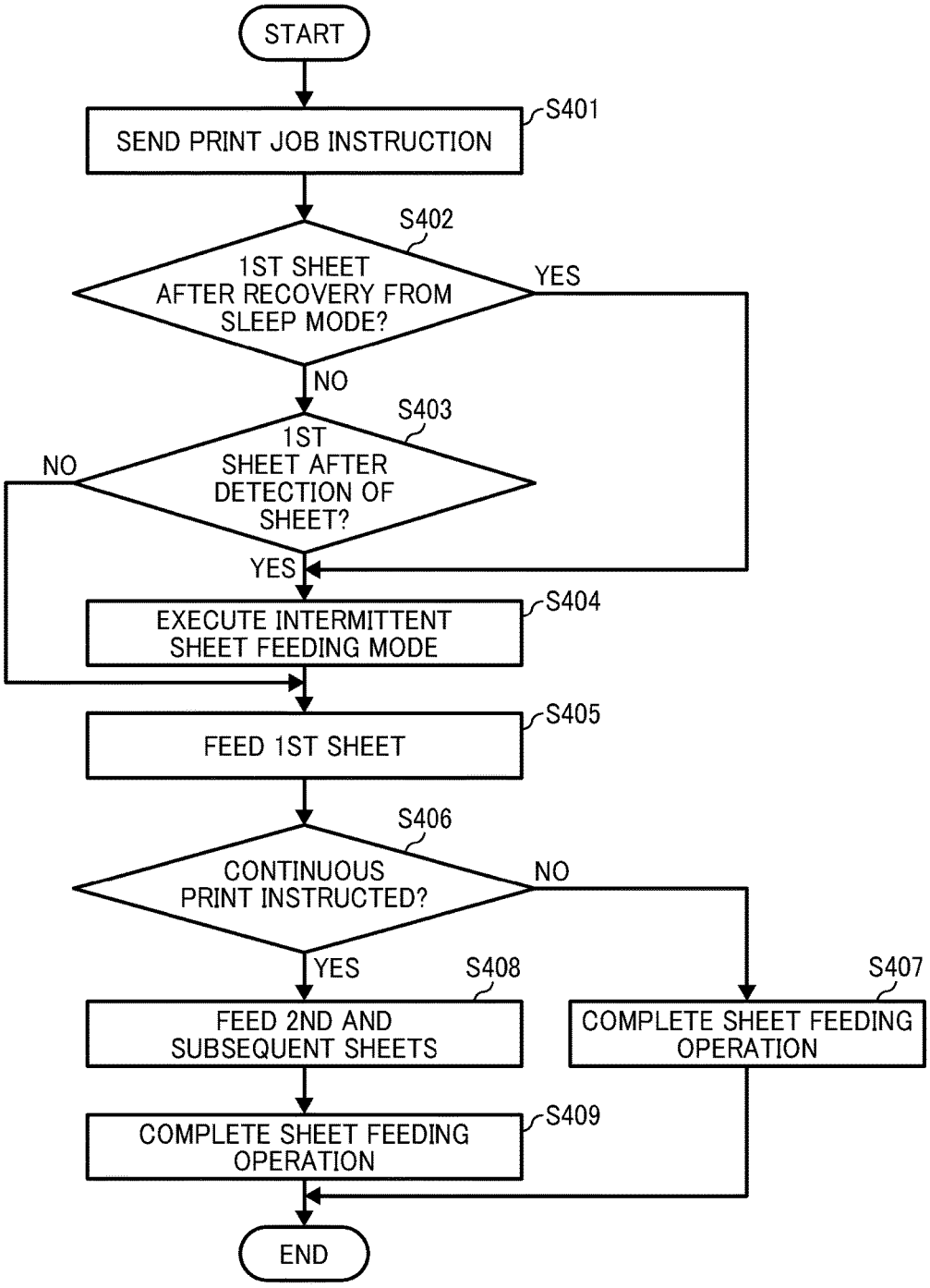
FIG. 14 is a flowchart of yet another sheet feeding operation according to the present embodiment of this disclosure.

Further, if the sleep mode is set in the sheet feeding device having the bypass tray 56, as a sheet feeding operation shown in a flowchart of FIG. 14, the intermittent sheet feeding mode is executed when feeding the first sheet after recovery from the sleep mode. By executing the intermittent sheet feeding mode, occurrence of noise due to reset of the sheet P on the bypass tray 56 during the sleep mode can be prevented. FIG. 14 is a flowchart of yet another sheet feeding operation according to the present embodiment of this disclosure. It is to be noted that, in the flowchart of FIG. 14, after a print job instruction is sent in step S401, it is determined whether or not it is the first sheet to be fed after recovery from the sleep mode, in step S402. When it is the first sheet to be fed after the recovery from the sleep mode (YES in step S402), the procedure goes to step S404 to execute the intermittent sheet feeding mode. When it is not the first sheet to be fed after the recovery from the sleep mode (NO in step S402), the procedure goes to step S403. In step S403, it is determined whether or not it is the first sheet to be fed after the sensor has detected presence of sheet on the bypass tray 56. When it is not the first sheet to be fed after the sensor has detected presence of sheet on the bypass tray 56 (NO in step S403), the sheet feeding operation is performed, in step S405. By contrast, when it is the first sheet to be fed after the sensor has detected presence of sheet on the bypass tray 56 (YES in step S403), the intermittent sheet feeding mode is executed when feeding the first sheet, in step S404. It is to be noted that, in the flowchart of FIG. 14, the sheet feeding operation performed in steps S405 through S409 are the same operations as steps S4 through S8, respectively, in the flowchart of FIG. 9. Therefore, the detailed description of the sheet feeding operation in these steps in the flowchart of FIG. 14 is omitted here.

Figure 15:
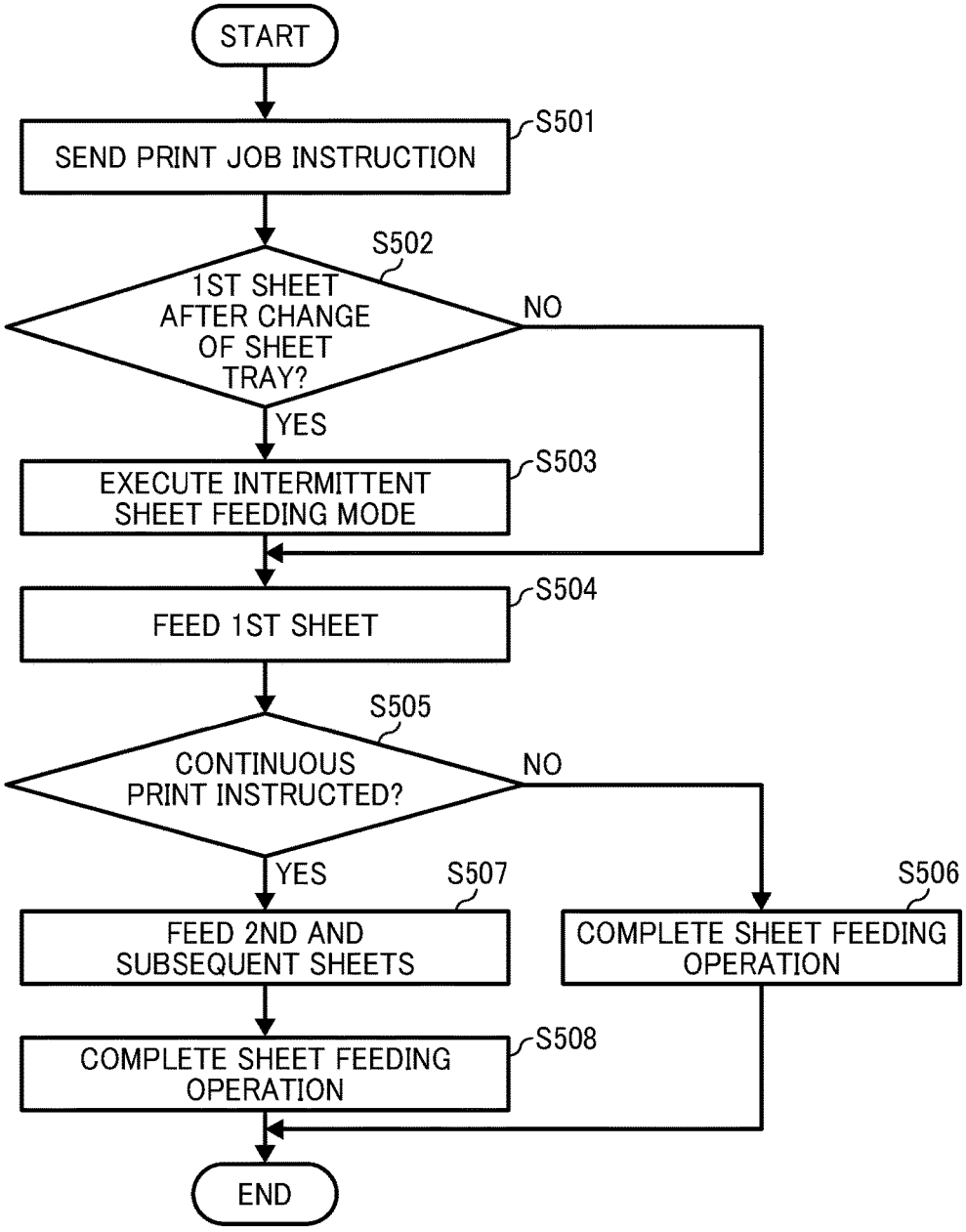
FIG. 15 is a flowchart of yet another sheet feeding operation according to the present embodiment of this disclosure.

FIG. 15 is a flowchart of yet another sheet feeding operation according to the present embodiment of this disclosure.

As shown in the flowchart of FIG. 15, the sheet feeding operation is performed in a case in which the sheet feeding device 6 includes multiple sheet trays 30. In the configuration in which the multiple sheet trays 30 are provided to the sheet feeding device 6, when a signal of empty of sheets accommodated in one sheet tray 30, a sheet is continuously fed from another sheet tray 30. In this case, no sheet is held between the sheet feed roller 32 and the separation pad 51 in the replaced sheet tray 30, and therefore noise or abnormal sound may occur due to vibration when feeding the first sheet from the replaced sheet tray 30. In order to address this inconvenience, in the flowchart of FIG. 15, after a print job instruction is sent in step S501, it is determined whether or not it is the first sheet to be fed after the sheet tray 30 is replaced to a new sheet tray 30, in step S502. When it is not the first sheet to be fed after replacement of the sheet tray 30 (NO in step S502), the procedure goes to step S504 to feed the first sheet. When it is the first sheet to be fed after replacement of the sheet tray 30 (YES in step S502), the procedure goes to step S503. Thereafter, the sheet feeding operation performed in steps S503 through S508 that are the same operations as steps S3 through S8, respectively, in the flowchart of FIG. 9. Therefore, the detailed description of the sheet feeding operation in these steps in the flowchart of FIG. 15 is omitted here. It is to be noted that information whether or not the sheet tray 30 is switched can be obtained based on detection results of a sensor that detects presence and absence of sheets in the sheet trays 30. Specifically, when the sensor detects absence of sheets, a sheet tray 30 of the multiple sheet trays 30 is switched to another sheet tray 30. It is to be noted that, when the second and subsequent sheets are handled in the sheet feeding operation of FIG. 15, similar to the above-described flowcharts of FIGS. 9 through 12 and 15, the sheets are fed in the regular sheet feeding mode without executing the intermittent sheet feeding mode.

Figure 16:
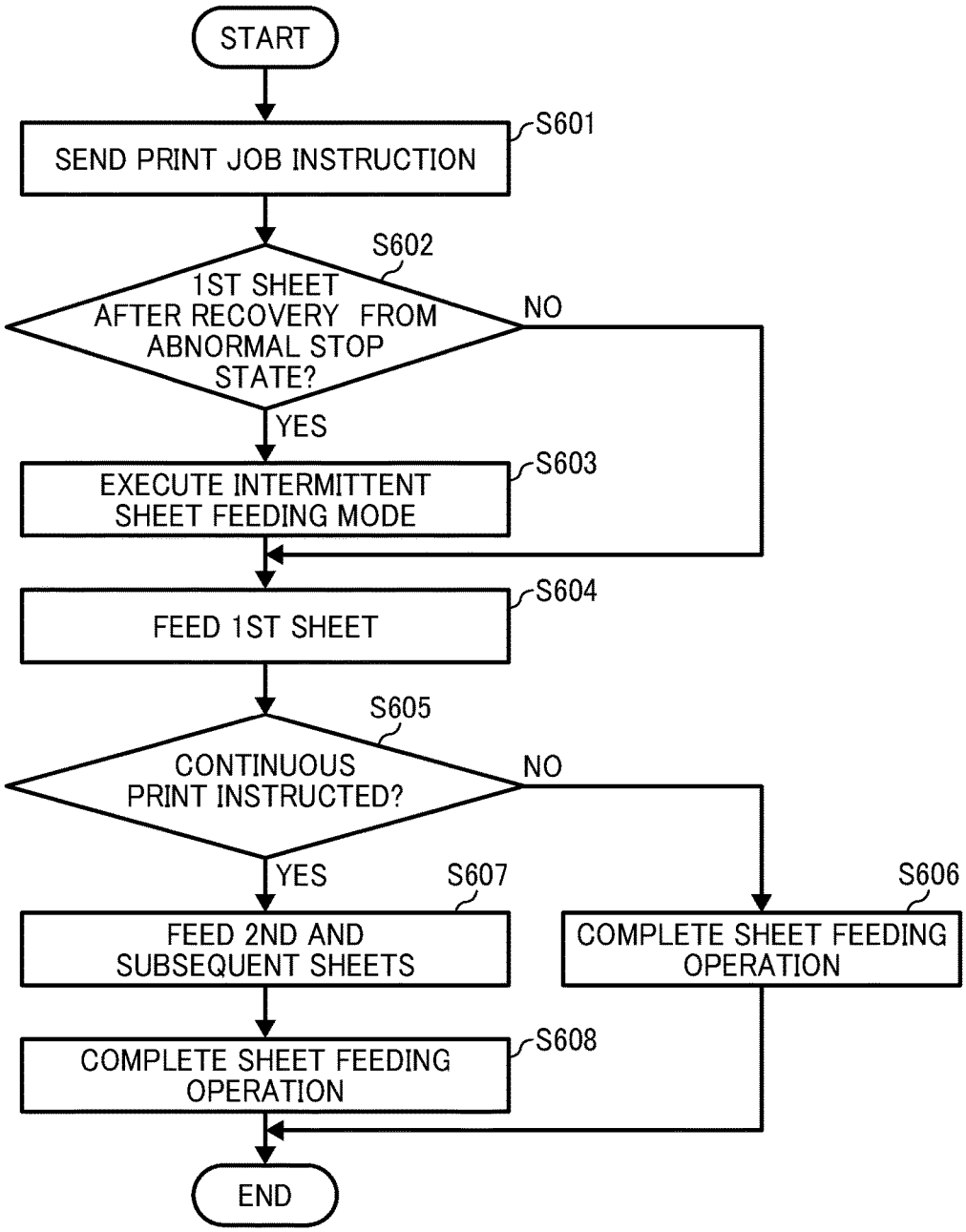
FIG. 16 is a flowchart of yet another sheet feeding operation according to the present embodiment of this disclosure.

FIG. 16 is a flowchart of yet another sheet feeding operation according to the present embodiment of this disclosure.

Generally, when abnormal state such as a paper jam occurs in an image forming apparatus, the image forming apparatus is controlled to stop image forming operations forcedly. In a case in which paper jam occurs and the image forming apparatus stops abnormally, a user opens the front cover 8 mounted on the apparatus body 100, thereby removing the jammed sheet. Further, at this time, the sheet tray 30 is removed from the apparatus body 100 to realign the sheets in the apparatus body 100. Thereafter, when the sheet tray 30 is attached to the apparatus body 100 again, no sheet is held between the sheet feed roller 32 and the separation pad 51, and therefore noise generated by vibration may occur when the first sheet is fed.

In order to remove the possibility of this inconvenience, as illustrated in FIG. 16, after a print job instruction is sent in step S601, it is determined whether or not it is the first sheet to be fed after recovery from an abnormal stop, in step S602. When it is not the first sheet to be fed after recovery from the abnormal stop (NO in step S602), the procedure goes to step S604 to feed the first sheet. When it is the first sheet to be fed after recovery from the abnormal stop (YES in step S602), the procedure goes to step S603. Thereafter, the sheet feeding operation performed in steps S603 through S608 that are the same operations as steps S3 through S8, respectively, in the flowchart of FIG. 9. Therefore, the detailed description of the sheet feeding operation in these steps in the flowchart of FIG. 16 is omitted here.

It is to be noted that, when the second and subsequent sheets are handled in the sheet feeding operation of FIG. 16, similar to the above-described flowcharts of FIGS. 9 through 12, 14, and 15, the sheets are fed in the regular sheet feeding mode without executing the intermittent sheet feeding mode.

It is to be noted that, in the present embodiment, a timing to terminate the intermittent sheet feeding mode, i.e., a timing whether or not the leading end of the sheet P has reached the separation nip region N2 is determined based on the distance from the sheet feeding start position of the sheet P to the separation nip region N2 and the distance of travel of the sheet P per intermittent rotation of the sheet feed roller 32. However, the determination of the timing to terminate the intermittent sheet feeding mode is not limited thereto. For example, a sheet-in-nip detecting device can be employed to determine whether or not the leading end of the sheet P has reached the separation nip region N2.

Figure 17:
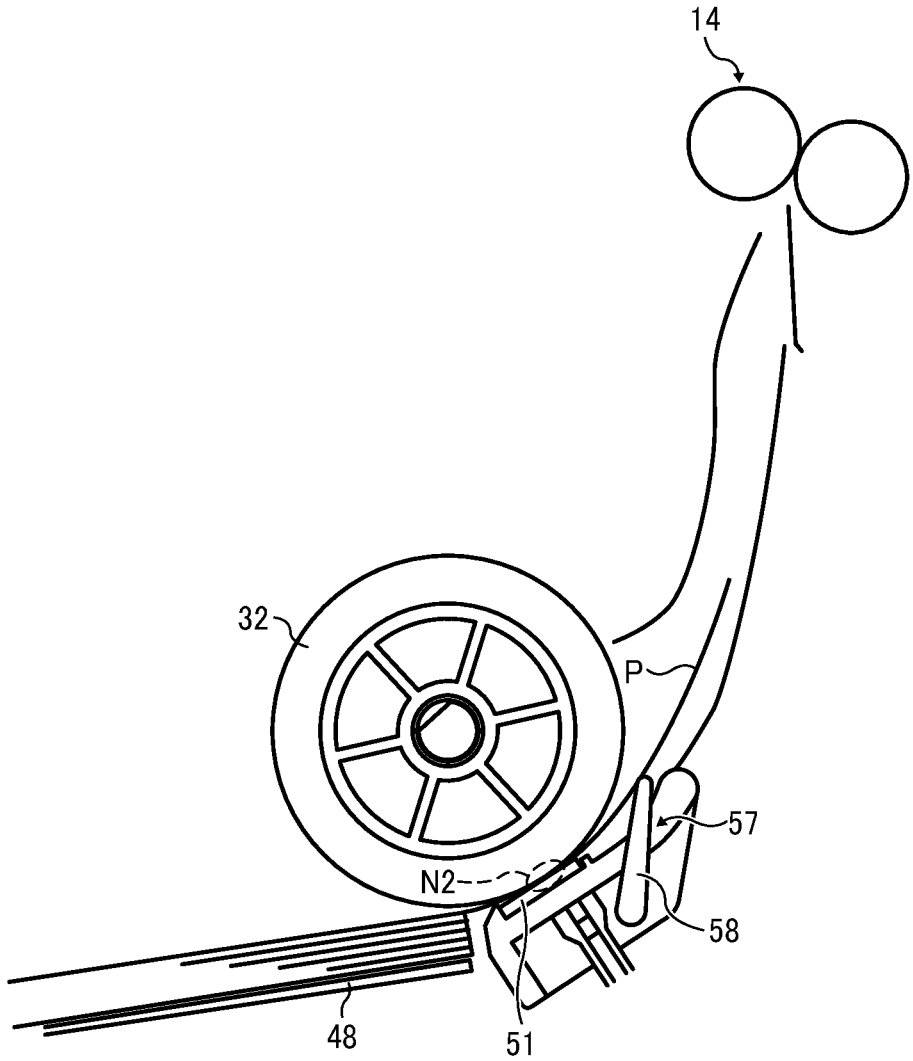
FIG. 17 is a diagram illustrating the sheet feeding device including a sheet-in-nip detecting device.

FIG. 17 is a diagram illustrating the sheet feeding device 6 including a sheet-in-nip detecting device 57.

As illustrated in FIG. 17, the sheet-in-nip detecting device 57 that functions as a nipped sheet detector includes a sheet output feeler 58 that is disposed near an area downstream from the separation nip region N2 in the sheet feeding direction and an optical sensor to detect movement of the sheet output feeler 58. The sheet output feeler 58 has a leading end and is designed to be swingable when the sheet P contacts the leading end thereof. If the leading end of the sheet P has not yet reached the separation nip region N2, the sheet P does not contact the sheet output feeler 58. When the sheet output feeler 58 blocks a light path in which light emitted from a light receiving part to a light receiving part of the optical sensor travels at this position, absence of the sheet P or the bundle of sheets P (i.e., a state in which the leading end of the sheet P or the bundle of sheets P has not yet reached the separation nip region N2) is detected.

By contrast, when the leading end of the sheet P passes through the separation nip region N2 and comes to contact the sheet output feeler 58, the sheet output feeler 58 swings so that the light emitted from the light receiving part of the optical sensor is received by the light receiving part of the optical sensor. Accordingly, presence of the sheet P or the bundle of sheets P (i.e., a state in which the leading end of the sheet P or the bundle of sheets P has reached the separation nip region N2) is detected. Thus, by employing the sheet-in-nip detecting device 57, arrival of the sheet P in the separation nip region N2 can be detected reliably.

Figure 18:
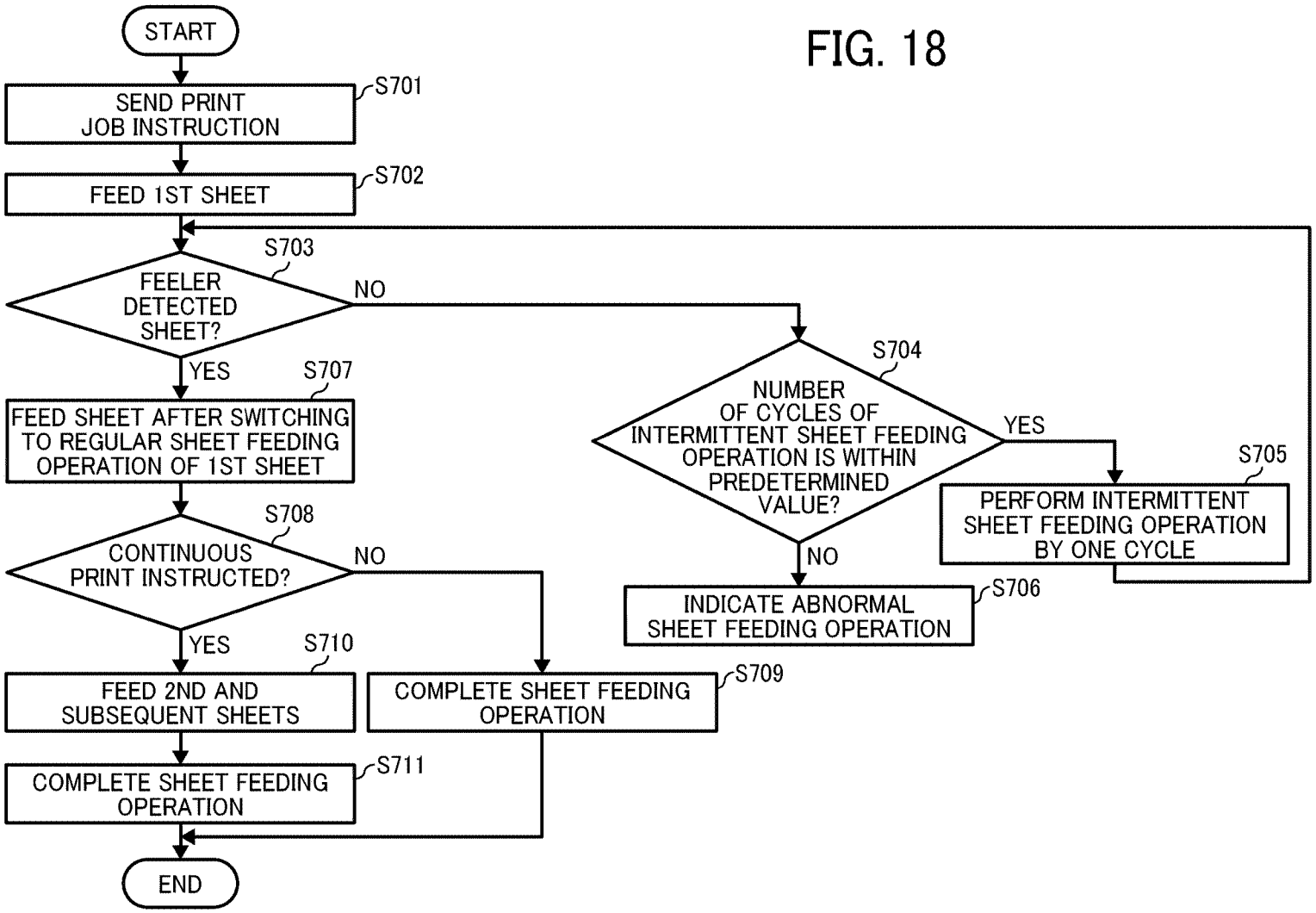
FIG. 18 is a flowchart of a sheet feeding operation performed with a sheet output feeler.

FIG. 18 is a flowchart of a sheet feeding operation performed with the sheet-in-nip detecting device 57 (the sheet output feeler 58).

In this case, after a print job instruction is sent in step S701, the sheet feeding device 6 starts to feed the first sheet in step S702. Then, in step S703, it is determined whether or not the sheet output feeler 58 has detected the sheet P. When the sheet output feeler 58 has not detected the sheet P (NO in step S703), it is determined that the leading end of the sheet P has not yet reached the separation nip region N2, and the procedure moves to steps S704 through S706 to perform the sheet feeding operation in the intermittent sheet feeding mode.

In the flow of the sheet feeding operation in the intermittent sheet feeding mode, one action of turning on the electromagnetic clutch 600 and one action of turning off the electromagnetic clutch 600 are regarded as one cycle of the intermittent sheet feeding process. In step S704, it is determined whether or not the number of cycles of the intermittent sheet feeding process performed in the sheet feeding operation is within a predetermined number of cycles.

The number of cycles of the intermittent sheet feeding process is zero immediately after the start of feeding a sheet. Therefore, it is determined that the number of cycles of the intermittent sheet feeding process is within the predetermined number of cycles (YES in step S704), and the intermittent sheet feeding process is performed by one cycle, in step S705. Then, it is determined whether or not the sheet output feeler 58 has detected the sheet P in step S703 again. When it is determined that the sheet output feeler 58 has not detected the sheet P (NO in step S703), it is determined whether or not the number of cycles of the intermittent sheet feeding process performed in the sheet feeding operation is within the predetermined number of cycles in step S704. When it is determined that the number of cycles of the intermittent sheet feeding process is within the predetermined number of cycles (YES in step S704), the intermittent sheet feeding process is performed by another one cycle, in step S705, and the process moves back to step S703 again to be repeated.

When it is determined that the number of cycles of the intermittent sheet feeding process exceeds the predetermined number of cycles (NO in step S704), a message of an abnormal operation is displayed, in step S706, and the operation terminates. Specifically, if the number of cycles of the intermittent sheet feeding process is within the predetermined number of cycles, the leading end of the sheet P is in contact with the sheet output feeler 58. However, the detection result is not, it is determined that an abnormal state such as a paper jam has occurred.

By contrast, as a result of repeated normal operations of the intermittent sheet feeding process without displaying any message of abnormal operations, when the sheet output feeler 58 has detected the sheet P (YES in step S703), it is determined that the leading end of the sheet P has reached the separation nip region N2, and the procedure moves to step S707 to switch the mode from the intermittent sheet feeding mode to the regular sheet feeding mode before feeding the first sheet. It is to be noted that, in the flowchart of FIG. 18, the sheet feeding operation performed in steps S708 through S711 are the same operations as steps S5 through S8, respectively, in the flowchart of FIG. 9. Therefore, the detailed description of the sheet feeding operation in these steps in the flowchart of FIG. 18 is omitted here. As described above, the configuration in the present embodiment employs the sheet-in-nip detecting device 57 (the sheet output feeler 58). By confirming the position of the sheet P by the sheet-in-nip detecting device 57 (the sheet output feeler 58), noise that is generated before the leading end of the first sheet reaches the separation nip region N2 can be prevented reliably. At the same time, since the intermittent sheet feeding process is not performed excessively, deterioration in productivity and a reduction in service life of the electromagnetic clutch 600 can be prevented. It is to be noted that, when the second and subsequent sheets are handled in the sheet feeding operation of FIG. 18, similar to the above-described flowcharts of FIGS. 9 through 12 and 14 through 16, the sheets are fed in the regular sheet feeding mode without executing the intermittent sheet feeding mode.

It is to be noted that, in the present embodiment, a timing to terminate the intermittent sheet feeding mode is determined based on the position of the leading end of the sheet P detected by the sheet output feeler 58. However, the determination of the timing to terminate the intermittent sheet feeding mode is not limited thereto. For example, a timing to terminate the intermittent sheet feeding mode can be determined based on a distance of travel of the sheet P from the sheet feeding sheet feeding start position of the first sheet.

Figure 19:
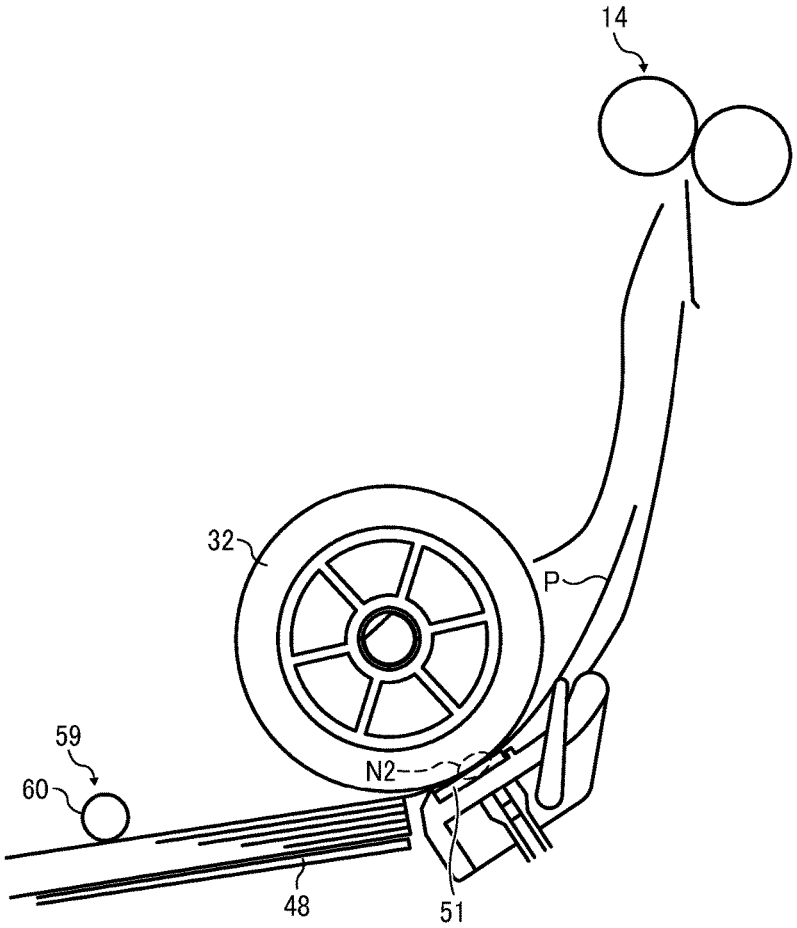
FIG. 19 is a diagram illustrating the sheet feeding device including a sheet travel distance measuring device.

FIG. 19 is a diagram illustrating the sheet feeding device including a sheet travel distance measuring device.

The sheet feeding device 6 of FIG. 19 includes an encoder 60 that functions as a sheet travel distance measuring device. The encoder 60 measures a distance of travel of the sheet P from the sheet feeding start position when the sheet P is loaded on the bottom plate 48. The encoder 60 is disposed in contact with the uppermost sheet P placed on top of the bundle of sheets loaded on the bottom plate 48. As the sheet feeding operation of the uppermost sheet P starts, the encoder 60 rotates with the movement (the feeding) of the sheet P. Based on the number of rotations of the encoder 60, the distance of travel of the uppermost sheet P is measured. Then, if the distance from the sheet feeding start position of the uppermost sheet P to the separation nip region N2 is previously informed, whether or not the distance of travel of the uppermost sheet P detected by the encoder 60 reaches a distance to the separation nip region N2 is determined, thereby detecting arrival of the uppermost sheet P to the separation nip region N2 reliably.

Figure 20:
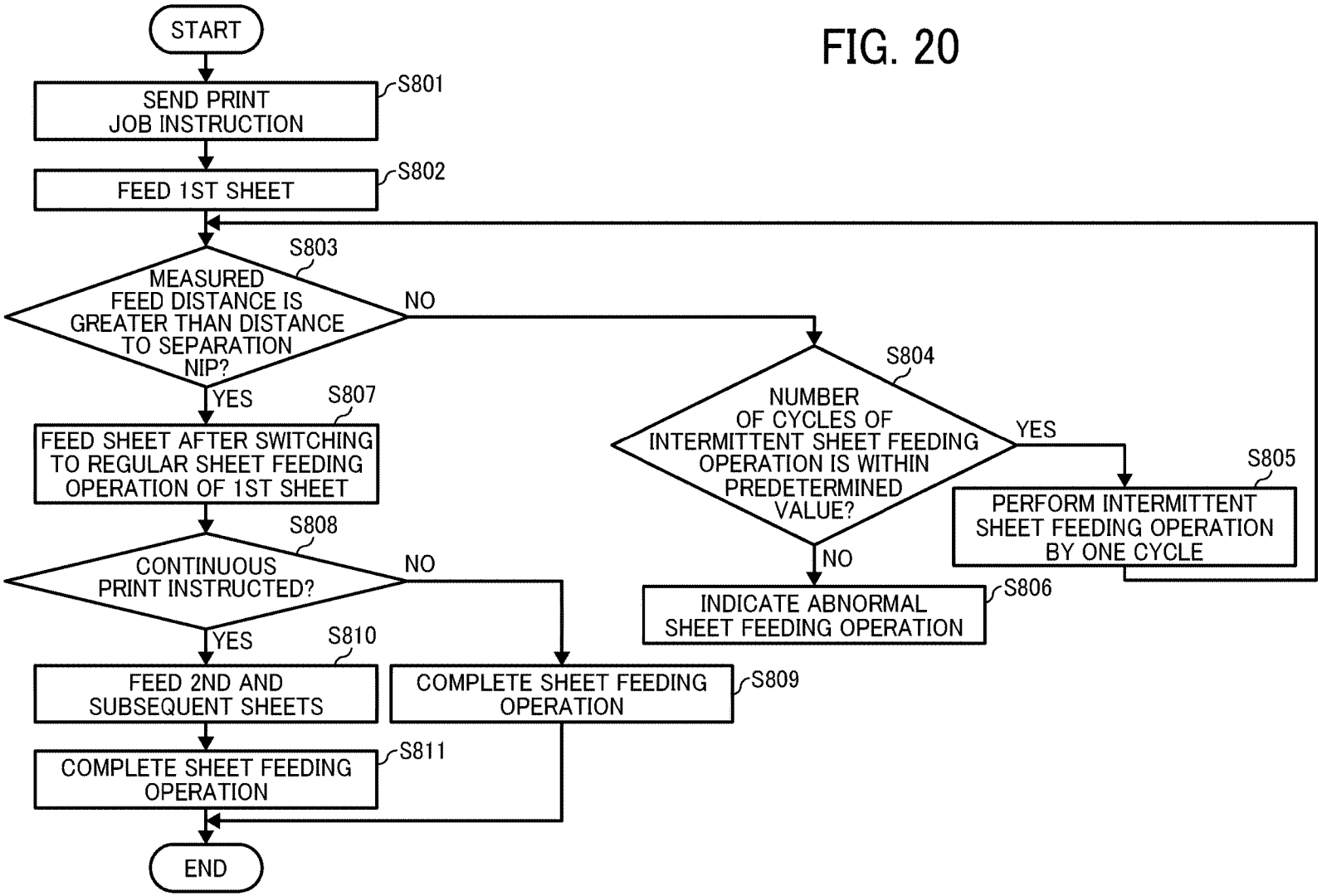
FIG. 20 is a flowchart of a sheet feeding operation performed with the sheet travel distance measuring device.

FIG. 20 is a flowchart of a sheet conveying operation performed with the encoder 60 that functions as a sheet travel distance measuring device.

In this case, after a print job instruction is sent in step S801, the sheet feeding device 6 starts to feed the first sheet in step S802. After step S802, the encoder 60 measures a distance of travel of the first sheet of the bundle of sheets loaded on the bottom plate 48. Then, in step S803, it is determined whether or not the measured distance is equal to or greater than the distance from the sheet feeding start position to the separation nip region N2. As a result, when the measured distance of travel of the sheet P is less than the distance from the sheet feeding start position to the separation nip region N2 (NO in step S803), it is determined that the leading end of the sheet P has not yet reached the separation nip region N2, and the procedure moves to steps S804 through S806 to perform the sheet feeding operation in the intermittent sheet feeding mode.

The flow of the intermittent sheet feeding process performed in steps S804 through S805 that are the same operations as steps S704 through S706, respectively, in the flowchart of FIG. 18. Specifically, the intermittent sheet feeding process is repeatedly performed by a predetermined number of times (by a predetermined number of cycles) until it is determined that the measured distance is equal to or greater than the distance from the sheet feeding start position to the separation nip region N2. However, when it is determined that the number of cycles of the intermittent sheet feeding process exceeds the predetermined number of cycles (NO in step S804), a message of an abnormal operation is displayed, in step S806, and the operation terminates.

As a result of repeated normal operations of the intermittent sheet feeding process without displaying any message of abnormal operations, when the measured distance becomes equal to or greater than the distance to the separation nip region N2 (YES in step S803), it is determined that the leading end of the sheet P has reached the separation nip region N2, and the procedure moves to step S807 to switch the mode from the intermittent sheet feeding mode to the regular sheet feeding mode before feeding the first sheet. It is to be noted that, in the flowchart of FIG. 20, the sheet feeding operation performed in steps S808 through S811 are the same operations as steps S5 through S8, respectively, in the flowchart of FIG. 9. Therefore, the detailed description of the sheet feeding operation in these steps in the flowchart of FIG. 20 is omitted here.

As described above, the configuration in the present embodiment employs the sheet travel distance measuring device (i.e., the encoder 60). By confirming the distance of travel of the sheet P by the encoder 60, noise that is generated before the leading end of the first sheet reaches the separation nip region N2 can be prevented reliably. At the same time, since the intermittent sheet feeding process is not performed excessively, deterioration in productivity and a reduction in service life of the electromagnetic clutch 600 can be prevented.

It is to be noted that, when the second and subsequent sheets are handled in the sheet feeding operation of FIG. 20, similar to the above-described flowcharts of FIGS. 9 through 12 and 14 through 16, the sheets are fed in the regular sheet feeding mode without executing the intermittent sheet feeding mode.

Figure 21:
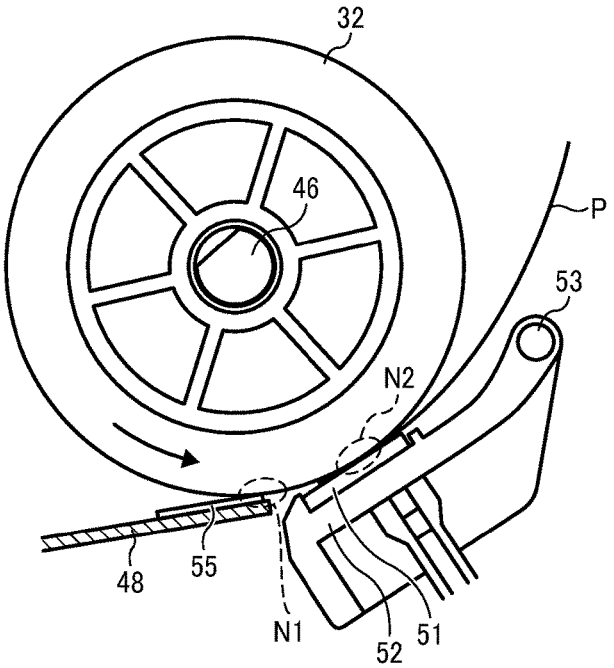
FIG. 21 is a diagram illustrating how a lowermost sheet is conveyed.

As described above, countermeasures with respect to noise or abnormal sound that may occur when the first sheet is fed are described. However, noise generated in the sheet feeding operation may also occur when a lowermost (last) sheet of the bundle of sheets is fed. For example, after the trailing end of the lowermost sheet P has passed through the nip region N1 formed between the sheet feed roller 32 and the loading face pad 55, as illustrated in FIG. 21, the sheet feed roller 32 rotates in a state in which the sheet feed roller 32 contacts the loading face pad 55 without any sheet therebetween. Therefore, as the sheet feed roller 32 rotates, a large load is applied to the nip region N1. Due to this large load, vibration is generated to the loading face pad 55 and the bottom plate 48, and is then transmitted to the parts disposed around the sheet feed roller 32, resulting in generation of noise.

Figure 22:
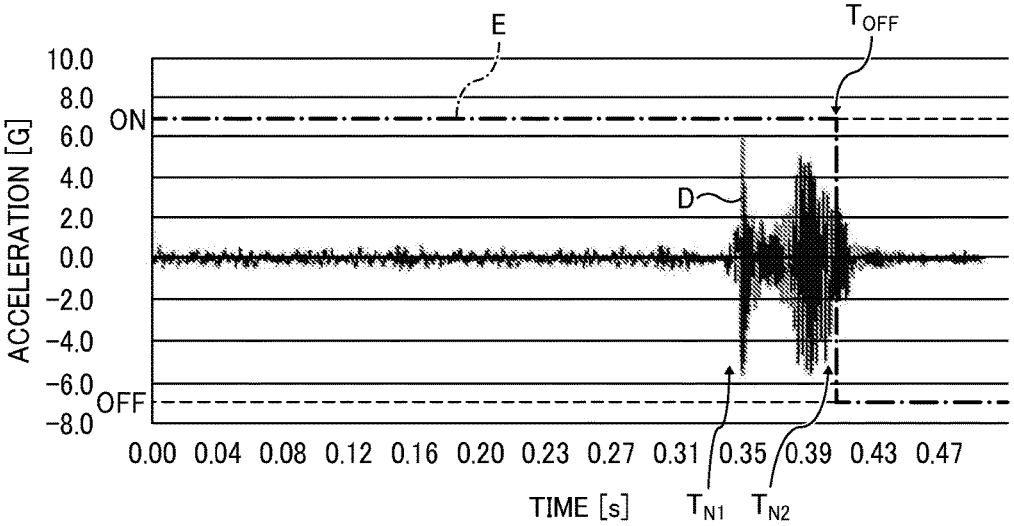
FIG. 22 is a graph of waves of vibration generated in a comparative sheet feeding device.

FIG. 22 is a graph of waves of vibration generated in a comparative sheet feeding device.

In FIG. 22, a solid line D indicates waves of vibration generated in the bottom plate 48 and a vertical axis indicates the degrees of the waves of vibration (acceleration [G]). A broken line E indicates a current value that flows in the electromagnetic clutch 600 that transmits the driving force to the sheet feed roller 32. At a timing ($T_{OFF}$) when the current value is decreased, the sheet feed roller 32 stops driving. Here, after the trailing edge of the lowermost sheet P has passed through the separation nip region N2, the rotation of the sheet feed roller 32 is stopped. A horizontal axis indicates time [s].

Specifically, after a timing $T_{N1}$ at which the trailing end of the lowermost sheet P has passed through the nip region N1 formed between the sheet feed roller 32 and the loading face pad 55, as illustrated in FIG. 22, the vibration increases toward a timing $T_{N2}$ at which the trailing end of the lowermost sheet P passes through the separation nip region N2. Thereafter, the vibration gradually decreases. Hereinafter, the nip region N1 is also referred to as the sheet feeding nip region N1. Due to the large load, vibration is generated to the bottom plate 48 and is continued for a certain period, noise occurs.

However, the vibration does not always hit the peak right after the trailing end of the lowermost sheet P has passed through the sheet feeding nip region N1. Accordingly, also in this case, similar to the above-described case in which the noise that occurs when the first sheet is fed, vibration may occur. Even so, if the vibration is restrained from increasing, occurrence of noise can be prevented. Based on the above-described findings, in order to eliminate the noise the lowermost sheet P according to the present embodiment of this disclosure has the following configuration.

Figure 23:
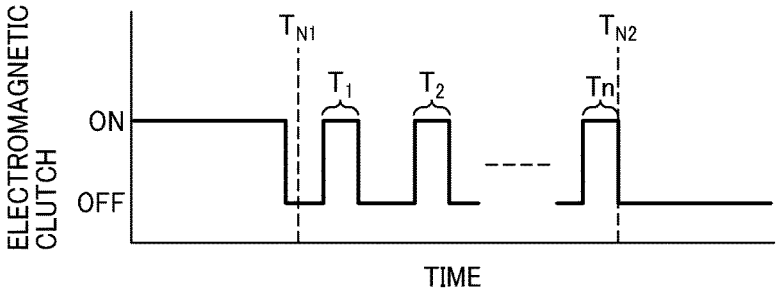
FIG. 23 is a timing chart of ON and OFF of an electromagnetic clutch according to the present embodiment of this disclosure.

FIG. 23 is a timing chart of ON and OFF of the electromagnetic clutch 600 according to the present embodiment of this disclosure.

As illustrated in FIG. 23, in the present embodiment, the electromagnetic clutch 600 is intermittently turned ON from a timing at which the trailing end of the lowermost sheet P has passed the sheet feeding nip region N1 (i.e., from a timing $T_{N1}$ in FIG. 23) before the a timing at which the trailing end of the lowermost sheet P passes through the separation nip region N2 (i.e., to a timing $T_{N2}$ in FIG. 23). By so doing, a time per one turning ON of the electromagnetic clutch 600 ($T_1$, $T_2$, . . . Tn) can be restrained. It is to be noted that, in the present embodiment, whether or not the sheet P fed from the sheet tray 30 is the lowermost sheet P is determined based on detection of absence of sheet loaded on the bottom plate 48 performed by the sheet loading feeler 62 (see FIG. 3).

A timing whether or not the trailing end of the lowermost sheet P has reached the sheet feeding nip region N1 is determined based on a distance Lsn and a sheet feeding speed Vp of the sheet feed roller 32. The distance Lsn extends from a trailing end position where the lowermost sheet P is separated from the sheet loading feeler 62 to the sheet feeding nip region N1. Specifically, a time Tz can be calculated using the following equation, Equation 1. The time Tz is from a timing at which the lowermost sheet P is not detected to a timing at which the trailing end of the lowermost sheet P reaches the sheet feeding nip region N1.

$$Tz = Lsn/Vp - Tsn \qquad \text{Equation 1.}$$

Here, "Tsn" in Equation 1 represents a chattering time across a series of processes that the sheet loading feeler 62 is released from contact with the lowermost sheet P, that the sheet loading feeler 62 enters in an opening formed on the bottom plate 48, that movement of the sheet loading feeler 62 becomes stable, and that the optical sensor detects no sheet. By calculating the time Tz using Equation 1, a timing at which the trailing end of the lowermost sheet P reaches the sheet feeding nip region N1 is indicated. Therefore, by repeating the power ON/OFF of the electromagnetic clutch 600 after the timing, the above-described sheet feeding operation can be controlled.

Thus, the electromagnetic clutch 600 is intermittently turned ON from a timing at which the trailing end of the lowermost sheet P has passed the sheet feeding nip region N1 until the lowermost sheet P passes through the separation nip region N2, so as to reduce the unit time per the power ON of the electromagnetic clutch 600. By so doing, an increase in vibration generated by continuous rotation of the sheet feed roller 32 in the state in which the sheet feed roller 32 is directly in contact with the sheet loading face pad 55 can be restrained. Therefore, occurrence of noise when feeding the lowermost sheet P can be prevented.

Figure 24:
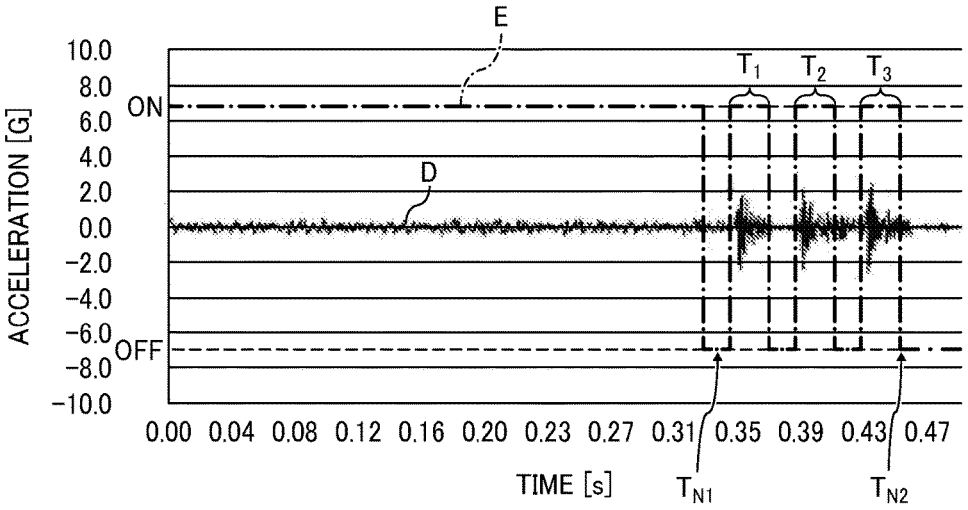
FIG. 24 is a graph of waves of vibration generated in the sheet feeding device according to the present embodiment of this disclosure.
Figure 25:
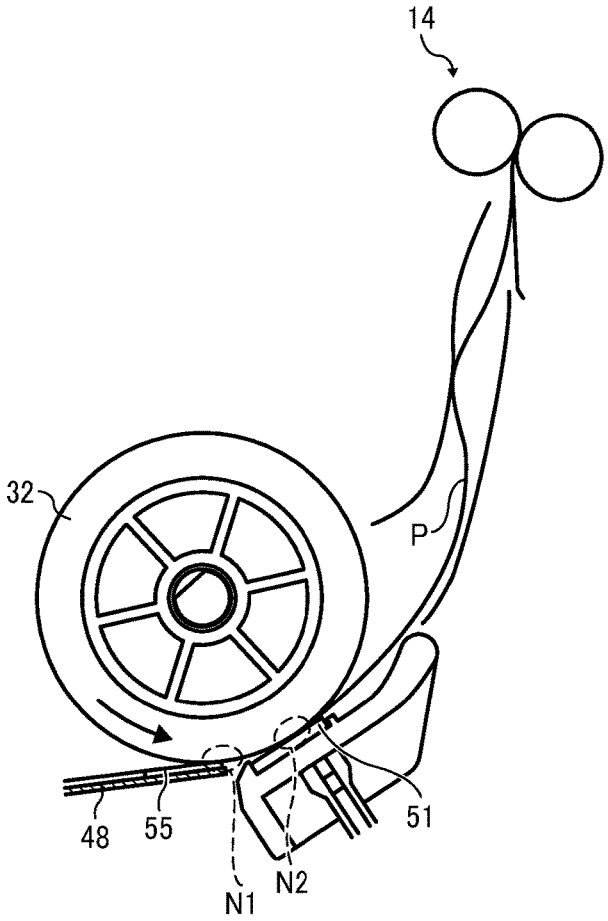
FIG. 25 is a diagram illustrating the sheet feeding device in a state in which a sheet is slackened between the sheet feed roller and a pair of timing rollers.
Figure 26:
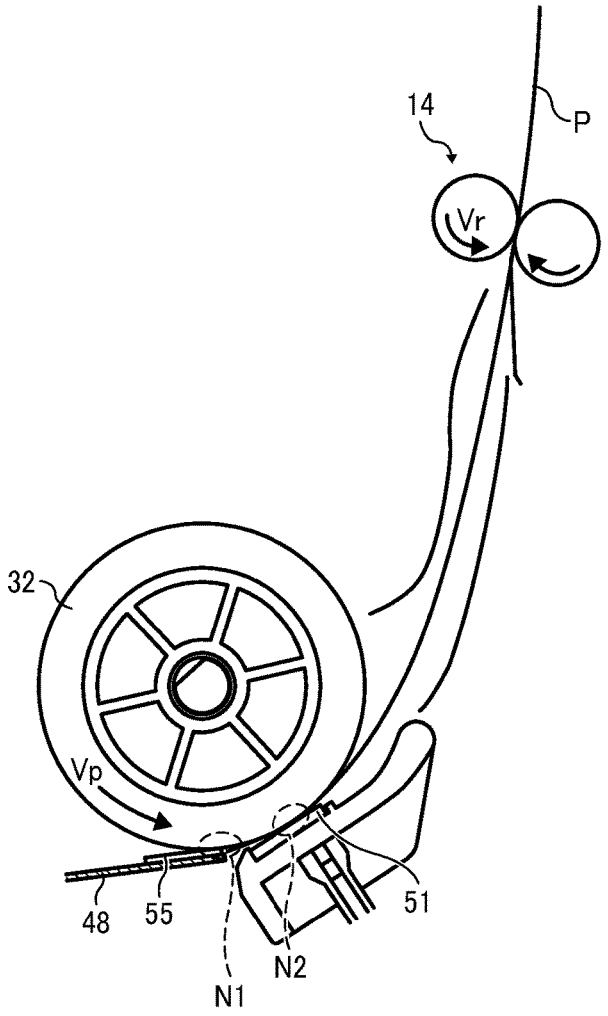
FIG. 26 is a diagram illustrating the sheet feeding device in a state in which the sheet is conveyed in a state in which the sheet is not being slackened.

FIG. 24 is a graph of waves of vibration generated in the sheet feeding device 6 according to the present embodiment of this disclosure.

Similar to the description with reference to FIG. 22, the solid line D in FIG. 24 indicates waves of vibration generated in the bottom plate 48 and the broken line E indicates current value that flows in the electromagnetic clutch 600 that transmits the driving force to the sheet feed roller 32.

As illustrated in FIG. 24, in the present embodiment, the electromagnetic clutch 600 is turned OFF immediately before the timing $T_{N1}$ at which the trailing end of the lowermost sheet P passes through the sheet feeding nip region N1, and thereafter, the electromagnetic clutch 600 is intermittently turned ON until the timing $T_{N2}$ at which the trailing end of the lowermost sheet P passes through the separation nip region N2. By so doing, a driving period of the sheet feed roller 32 per the power ON of the electromagnetic clutch 600 is reduced from the trailing end of the lowermost sheet P has passed the sheet feeding nip region N1 before the trailing end of the lowermost sheet P passes through the separation nip region N2. Therefore, an increase in vibration can be restrained. Specifically, the degree of vibration was about 5.8 [G] and the continuous time of vibration was 0.08 [s] in the example of no intermittent power ON described with reference to FIG. 22. By contrast, the degree of vibration (at $T_1$, $T_2$, and $T_3$) when the electromagnetic clutch 600 is turned ON intermittently is reduced to about 2.5 [G] and the continuous time of vibration is reduced to 0.025 [s] in the present embodiment of FIG. 24.

It is to be noted that the sheet P is held between the sheet feed roller 32 and the loading face pad 55 before the trailing end of the lowermost sheet P passes through the sheet feeding nip region N1. Therefore, even if the power ON of the electromagnetic clutch 600 is not performed intermittently, vibration is restrained. Accordingly, the intermittent sheet feeding mode in which the electromagnetic clutch 600 is intermittently turned ON is not executed before the trailing end of the lowermost sheet P passes through the sheet feeding nip region N1 but the regular sheet feeding mode in which the sheet is fed serially is executed.

As described above, an increase in vibration can be restrained by reducing the time of the turn ON of the electromagnetic clutch 600. However, if the time of turning ON of the electromagnetic clutch 600 is reduced, the number of turning OFF of the electromagnetic clutch 600 increases. Consequently, an average speed of conveyance of sheet is reduced, and therefore the productivity is deteriorated. Therefore, in the present embodiment, the productivity is considered. Accordingly, when the electromagnetic clutch 600 is turned ON intermittently, the number of repeats of turning ON and OFF of the electromagnetic clutch 600 is set to 3, the time of turning ON of the electromagnetic clutch 600 is set to 0.025 [s], and the time of turning OFF of the electromagnetic clutch 600 is set to 0.15 [s].

The sheet P fed by the sheet feed roller 32 is temporarily stopped by the pair of timing rollers 14 that is disposed downstream from the sheet feed roller 32 in the sheet feeding direction. By this temporary stoppage, the sheet P slackens between the sheet feed roller 32 and the pair of timing rollers 14, so that skew of the sheet P is corrected. Then, by starting the rotation of pair of timing rollers 14 and the sheet feed roller 32 again at a predetermined timing, the sheet P is conveyed to a further downstream side in the sheet feeding direction.

At this time, if a sheet conveying speed Vr of the pair of timing rollers 14 (an average sheet conveying speed) is greater than the sheet feeding speed Vp of the sheet feed roller 32 (an average sheet feeding speed), which is expressed as Vp<Vr, even the electromagnetic clutch 600 is intermittently turned on after the trailing end of the lowermost sheet P has passed the sheet feeding nip region N1, noise may not be eliminated. That is, as a result of gradual elimination of slack of the sheet P due to a speed difference between the sheet feed roller 32 and the pair of timing rollers 14, when the sheet P is pulled and stretched by the pair of timing rollers 14, the sheet feed roller 32 is rotated with the pair of timing rollers 14. This action cannot retain vibration effectively, and therefore noise may occur, which may need to be avoided.

Figure 27:
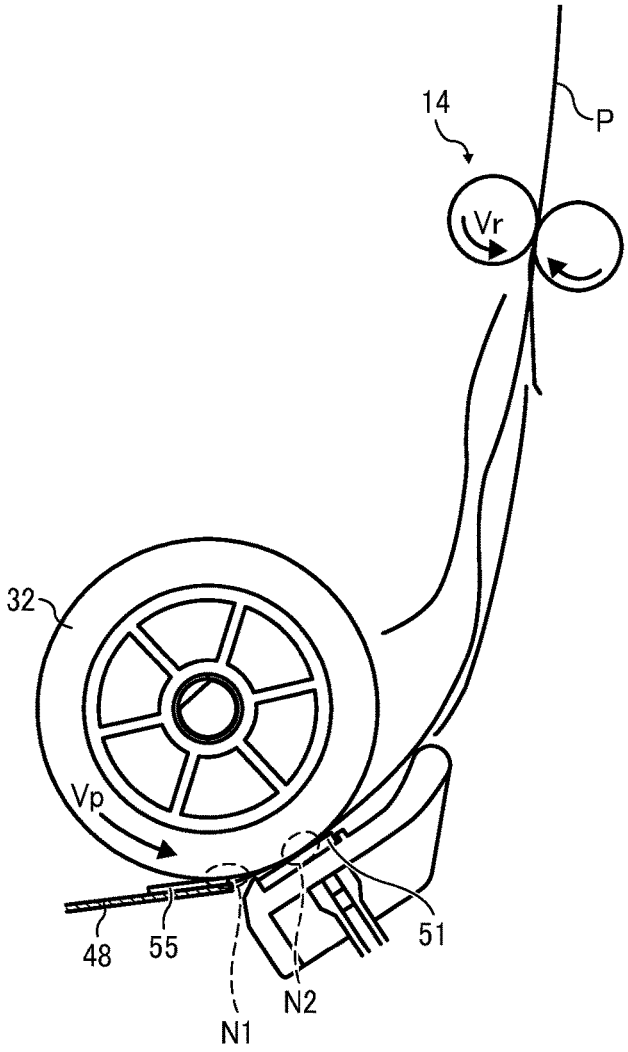
FIG. 27 is a diagram illustrating the sheet feeding device in a state in which the sheet is conveyed in a state in which the sheet is being slackened.

In order to prevent the above-described state that the sheet feed roller 32 is rotated with the pair of timing rollers 14, the sheet feeding speed Vp of the sheet feed roller 32 (the average sheet feeding speed) is set greater than the conveying speed Vr of the pair of timing rollers 14 (the average sheet conveying speed), which is expressed as Vp>Vr, and the sheet P remains slackened between the sheet feed roller 32 and the pair of timing rollers 14 at least while the sheet feed roller 32 feeds the sheet P intermittently, as illustrated in FIG. 27. By maintaining slack of the sheet P while the sheet feed roller 32 feeds the sheet P intermittently, even if the conveying speed Vr of the pair of timing rollers 14 (the average sheet conveying speed) is greater than the sheet feeding speed Vp of the sheet feed roller 32 (the average sheet feeding speed), the sheet P is not pulled or stretched by the pair of timing rollers 14, which can prevent the sheet feed roller 32 from being rotated with the pair of timing rollers 14.

Here, the sheet feeding speed of the sheet feed roller 32 (the average sheet feeding speed) is represented as "Vp" [mm/s], the conveying speed of the pair of timing rollers 14 (the average sheet conveying speed) is represented as "Vr" [mm/s], a length of a sheet feeding path from the sheet feeding nip region N1 to the separation nip region N2 is represented as "Ln" [mm], a length of a sheet feeding path from the separation nip region N2 to a nip region formed by the pair of timing rollers 14 is represented as "Lpr" [mm], a sheet length (the length of the sheet P in the sheet feeding direction) is represented as "L" [mm], an initial amount of slack of the sheet P provided by the pair of timing rollers 14 is represented as "r" [mm], and an amount of slack of the sheet P after the trailing end of the sheet P has passed through the sheet feeding nip region N1 is represented as "R" [mm]. With this condition, the amount of slack R can be calculated using the following equation, Equation 2.

$$R=r+(L-n-Lpr)(Vp/Vr-1) \quad \text{Equation 2.}$$

Further, it is preferable that, after the trailing end of the lowermost sheet P has passed through the sheet feeding nip region N1, even if the electromagnetic clutch 600 is turned ON and OFF by two or more times, the slack of the sheet P is maintained and rotation of the sheet feed roller 32 with the pair of timing rollers 14 is prevented. In order to achieve this state, the sum of the power OFF times (Tb1, Tb2, . . . and Tbn) of the electromagnetic clutch 600 is set to be smaller than the amount of slack R. The sum can be calculated using the following equation, Equation 3.

$$\sum_{k=1}^{n} TbkVr < r + (L - Ln - Lpr)(Vp / Vr - 1). \quad \text{Equation 3}$$

By satisfying the relation expressed by Equation 3, the amount of slack R of the sheet P after the trailing end of the sheet P has passed through the sheet feeding nip region N1 can be maintained. Therefore, the action in which the sheet feed roller 32 is rotated with the pair of timing rollers 14 can be prevented. However, since the amount of slack R of the sheet P varies according to a sheet length L, if the sheet length L is short, the relation expressed by Equation 3 may not be maintained. By increasing the initial amount of slack r, the subsequent amount of slack R can be maintained. However, if the initial amount of slack r is evenly increased in a range from a sheet having the minimum length to a sheet having the maximum length, the sheet having the maximum length may have an excessive amount of slack, which is likely to cause noise and sheet creases.

Accordingly, it is preferable that the initial amount of slack r is set to be variable according to the sheet length L. By so doing, the relation expressed by Equation 3 can be satisfied without causing noise and sheet creases.

Now, a description is given of operation conditions of the intermittent sheet feeding mode in which the electromagnetic clutch 600 is turned ON intermittently when feeding the lowermost sheet P.

Figure 28:
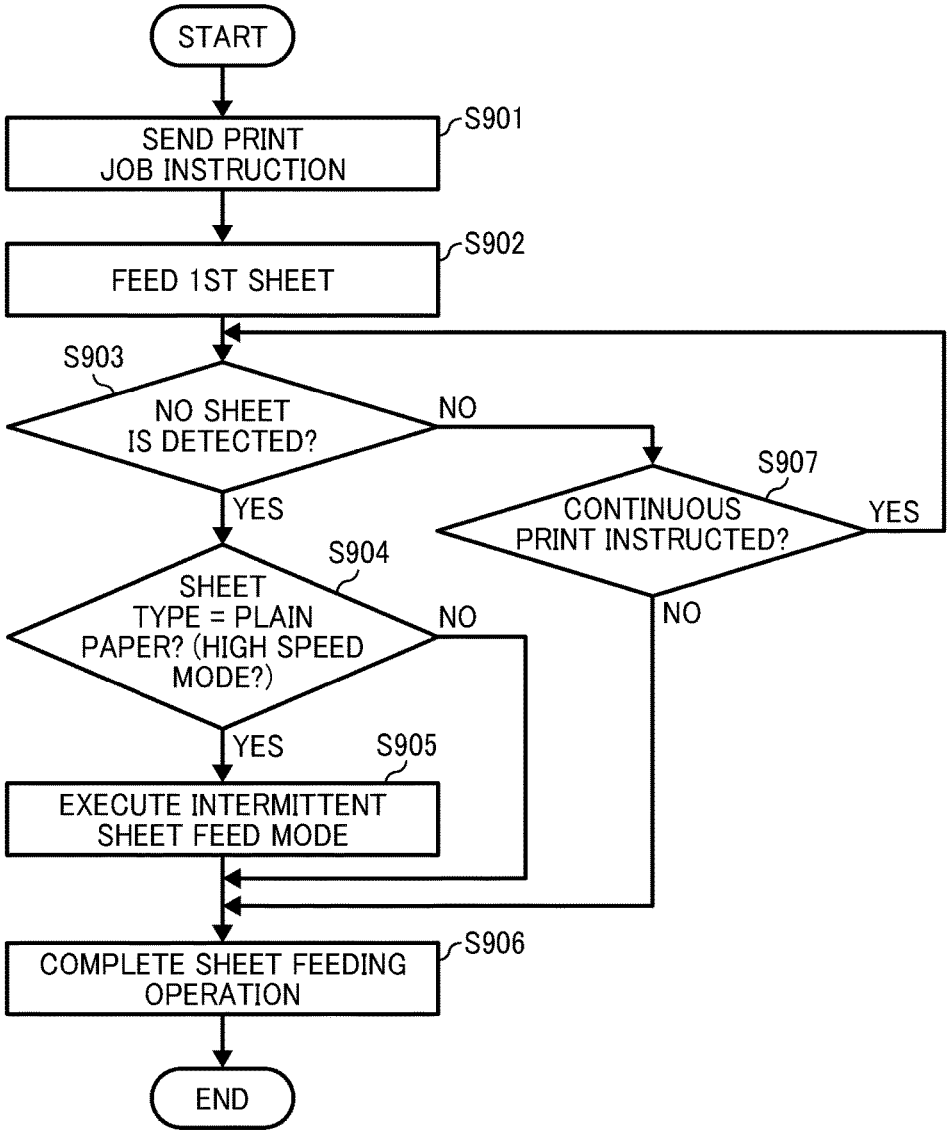
FIG. 28 is a flowchart of a sheet feeding operation according to the present embodiment of this disclosure.

FIG. 28 is a flowchart of a sheet feeding operation according to the present embodiment of this disclosure. The flowchart of FIG. 28 shows procedures to determine whether or not the intermittent sheet feeding mode is executed according to a sheet feeding speed that is set based on a sheet type (e.g., material, thickness, etc.).

Here, similar to the sheet feeding operation shown in the flowchart of FIG. 9, the high speed mode that is selected when feeding sheets of the plain paper type and the low speed mode that is selected when feeding sheets such as a thick paper are previously set.

As illustrated in FIG. 28, after a print job instruction is sent in step S901, the sheet operation device 6 starts to feed the first sheet in step S902. Then, in step S903, it is determined whether or not the sheet loading feeler 62 has detected out of sheets (no sheet is loaded) on the bottom plate 48. As a result, when the sheet loading feeler 62 has detected out of sheets on the bottom plate 48 (YES in step S903), it is determined that the lowermost sheet P is currently being fed, and the process goes to step S904. In step S904, it is determined whether or not a sheet selected in the image forming apparatus 500 is a plain paper type, that is, whether or not a selected print mode is the high speed mode. As a result, when the plain paper type (the high speed mode) is selected (YES in step S904), the intermittent sheet feeding mode is executed when feeding the lowermost sheet P, in step S905. Then, the sheet feeding operation is completed, in step S906.

As described above in the flowchart of FIG. 28, when the lowermost sheet P of the plain paper type is fed, noise is generated easily in the high speed mode due to vibration generated while feeding the sheet. Therefore, the intermittent sheet feeding mode is executed, so that an increase in vibration while feeding the sheet is restrained, preventing occurrence of noise.

By contrast, even when the lowermost sheet P is fed, if the sheet is not the plain paper type but a thick paper (NO in step S904), the low speed mode is selected, and therefore noise due to vibration does not occur easily. Therefore, the lowermost sheet P is fed not in the intermittent sheet feeding mode but in the low speed mode that is previously set (NO in step S904), and completes the sheet feeding operation, in step S906.

Further, when the sheet loading feeler 62 has not detected out of sheets on the bottom plate 48, in other words, presence of sheets on the bottom plate 48 is detected (NO in step S903), the sheet that is currently fed is not the lowermost sheet. In this case, it is further determined whether or not the above-described print job instruction indicates a continuous printing of multiple sheets in the image forming apparatus 500, in step S907. As a result, when the print job instruction indicates a printing of one sheet (NO in step S907), the intermittent sheet feeding mode is not executed and the sheet conveying operation completes, in step S906. By contrast, when the print job instruction indicates the continuous printing of multiple sheets (YES in step S907), the procedure goes back to step S903 to repeat the same procedure until the continuous printing completes.

As described above in the flowchart of FIG. 28, when noise due to vibration occurs easily according to the settings according to the sheet type or the setting of the sheet feeding speed based on the sheet type, the intermittent sheet feeding mode is executed when feeding the first sheet. By so doing, occurrence of noise can be prevented.

Further, the intermittent sheet feeding mode is selectively executed when the first sheet that is a plain paper type is fed, in other words, when the first sheet is fed in the high speed mode. That is, the intermittent sheet feeding mode is not executed in any other cases. Accordingly, deterioration in productivity of image formation and a reduction in service life of the electromagnetic clutch 600 can be prevented.

It is to be noted that the above-described sheet feeding operation of FIG. 28 according to the present embodiment includes two modes, which are the high speed mode and the low speed mode. However, the sheet feed mode is not limited thereto. For example, a sheet feeding operation may include three modes such as a high speed mode, a low speed mode, and an intermediate speed mode. Alternatively, a sheet feeding operation may include four or more modes.

It is to be noted that, in the present embodiment, a timing to start the intermittent sheet feeding mode, i.e., a timing whether or not the trailing end of the sheet P has reached the sheet feeding nip region N1 is determined based on the result obtained by Equation 1. However, even if the speed of rotation of the sheet feed roller 32 is constant, the sheet P may slip on the separation pad 51 due to a friction load. Therefore, a time to perform the sheet feeding operation is likely to vary. Further, an amount of slip of the sheet P may vary according to characteristics of surface preparation and rigidity of the sheet P. Accordingly, in order to execute the intermittent sheet feeding mode reliably when feeding the lowermost sheet P, a timing to start the intermittent sheet feeding mode is to be set after preferably considering variation of sheet feeding times due to the amount of slip of the sheet P.

However, with this setting, since the intermittent sheet feeding mode is started earlier than a timing at which the trailing end of the lowermost sheet P passes through the sheet feeding nip region N1. Accordingly, the number of times of repeating the power ON/OFF of the electromagnetic clutch 600, and therefore the service life of the electromagnetic clutch 600 is likely to deteriorate. Further, if the amount of slack R of the sheet P is to be maintained by considering variation of the sheet feeding times due to the amount of slip of the sheet P, the initial amount of slack r is increased, which may cause noise and sheet creases.

Figure 29:
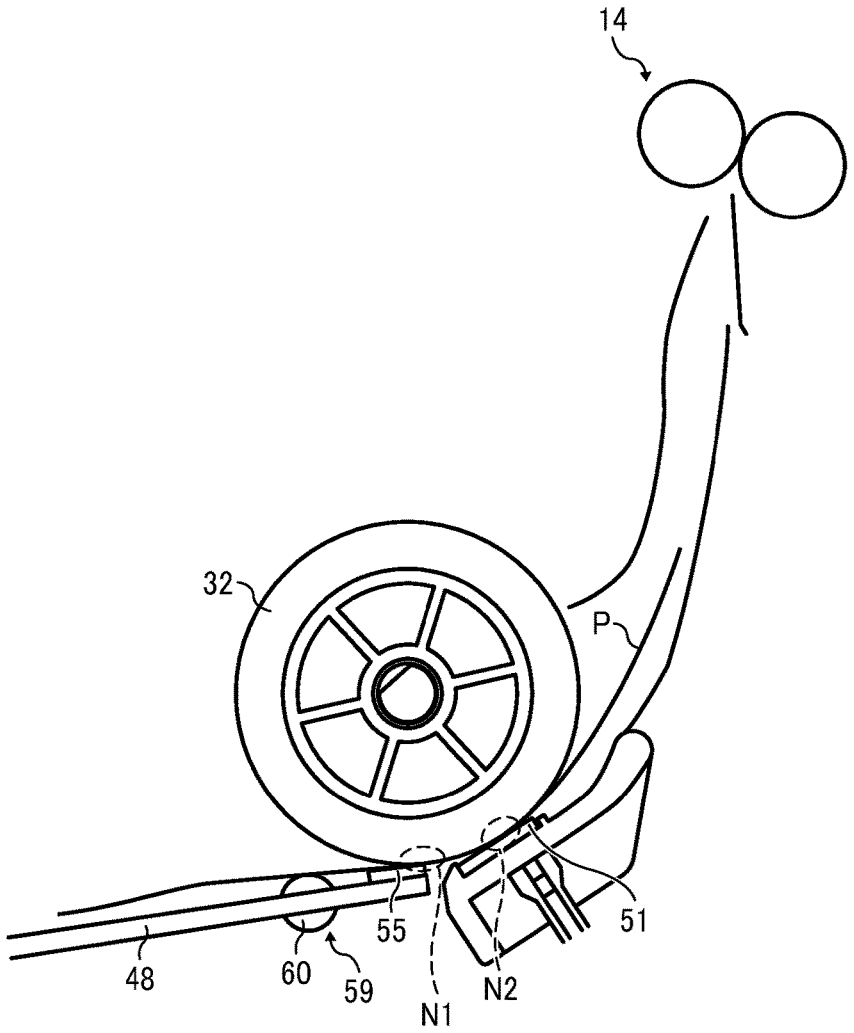
FIG. 29 is a diagram illustrating the sheet feeding device including the sheet travel distance measuring device.

In order to detect the sheet feeding position of the sheet P reliably, the sheet feeding device 6 may further include an encoder 60 that is mounted on the bottom plate 48, as illustrated in FIG. 29. As the sheet feeding operation of the lowermost sheet P starts, the encoder 60 that functions as a sheet travel distance measuring device rotates along with the movement (the feeding) of the lowermost sheet P. Based on the number of rotations of the encoder 60, the distance of travel of the lowermost sheet P is measured. Then, a sheet feeding speed is calculated based on the distance of travel of the lowermost sheet P and the time of rotation of the encoder 60. With the calculated sheet feeding speed, a timing at which the trailing end of the lowermost sheet P passes through the sheet feeding nip region N1.

Here, the sheet feeding speed of the sheet P obtained based on the speed of rotation of the encoder 60 is represented as "v" [mm/s], a length of a sheet feeding path from a contact position at which the encoder 60 contacts the sheet P to the sheet feeding nip region N1 is represented as "Le" [mm], a length of a sheet feeding path from the sheet feeding nip region N1 to the separation nip region N2 is represented as "Ln" [mm], a minimum time determined that the rotation of the encoder 60 has stopped is represented as "Te" [s], a timing at which the intermittent sheet feeding mode starts is represented as "Tx" [s], and a timing at which the intermittent sheet feeding mode ends is represented as "Ty" [s]. With this condition, the timing Tx and the timing Ty can be calculated using the following equations, Equation 4 and Equation 5.

$$Tx=Le/v-Te \quad \text{Equation 4.}$$

$$Ty=(Le+Ln)/v-Te \quad \text{Equation 5.}$$

By employing the encoder 60, the sheet feeding speed of the sheet P including the amount of slip of the sheet P can be calculated, the timing at which the trailing end of the sheet P reaches the sheet feeding nip region N1 can be detected reliably. Accordingly, the time of repeating the power ON/OFF of the electromagnetic clutch 600 and the initial amount of slack r can be set to the respective minimum values. Therefore, a reduction in service life of the electromagnetic clutch 600 and occurrence of noise and sheet creases due to the large initial amount of slack r can be prevented. Further, in a case in which the sheet loading feeler 62 is employed to detect the feeding of the lowermost sheet P, the sheet loading feeler 62 is limited to be disposed at a position separated upstream from the sheet feeding nip region N1 in the sheet feeding direction in consideration of the chattering time of the sheet loading feeler 62. By contrast, in a case in which the encoder 60 is employed, the position of the encoder 60 is not limited.

Figure 30:
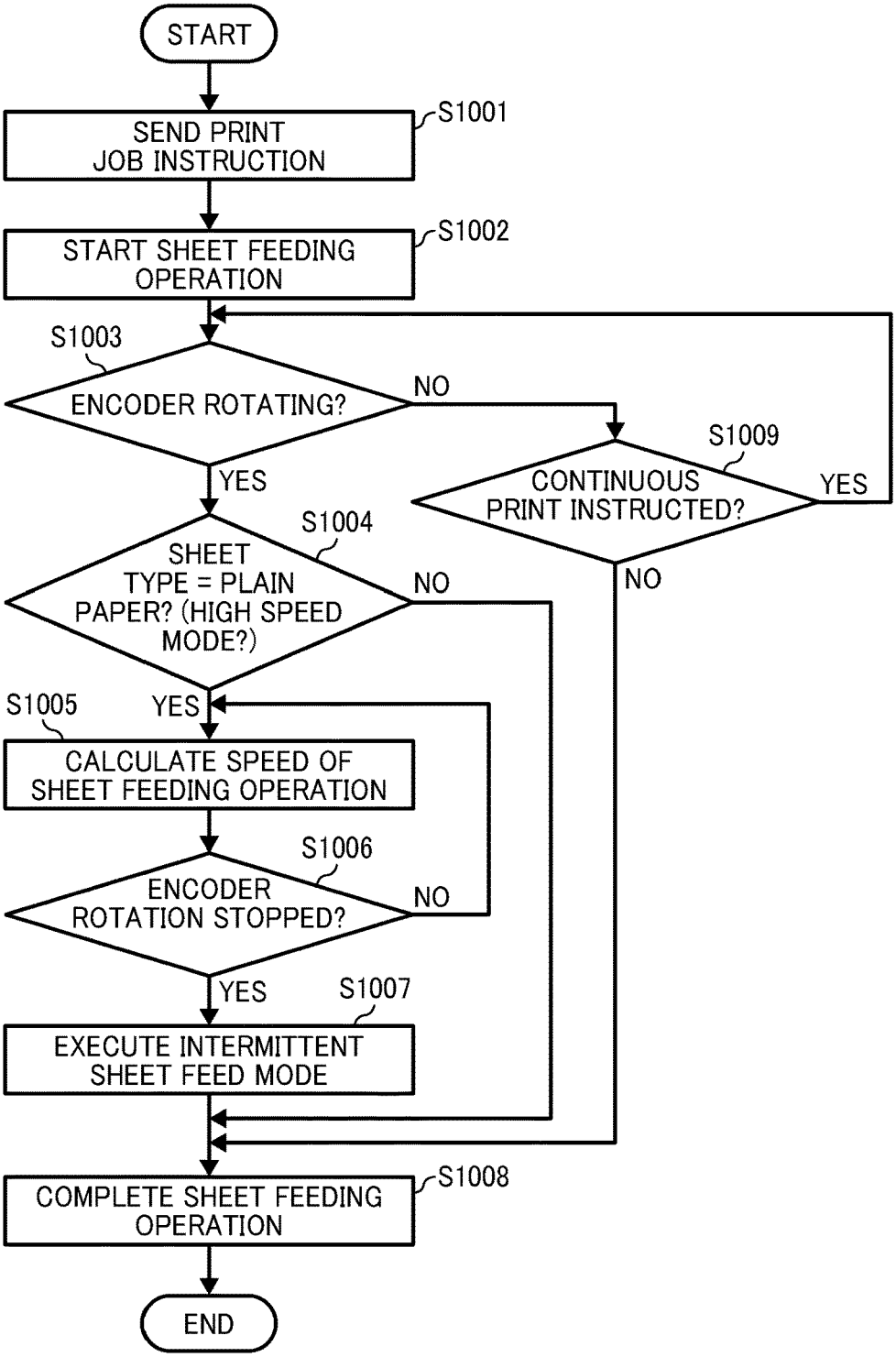
FIG. 30 is a flowchart of a sheet feeding operation performed with the sheet travel distance measuring device.

FIG. 30 is a flowchart of a sheet feeding operation performed with the encoder 60 that functions as a sheet travel distance measuring device.

As illustrated in FIG. 30, after a print job instruction is sent in step S1001, the sheet operation device 6 starts to feed the first sheet in step S1002. Then, in step S1003, it is determined whether or not the encoder 60 is rotating in the image forming apparatus 500. As a result, when the encoder 60 is rotating in the image forming apparatus 500 (YES in step S1003), it is determined that the lowermost sheet P is currently being fed, and the process goes to step S1004. In step S1004, it is determined whether or not a sheet selected in the image forming apparatus 500 is a plain paper type, that is, whether or not a selected print mode is the high speed mode. As a result, when the plain paper type (the high speed mode) is selected (YES in step S1004), the sheet feeding speed of the sheet P is calculated based on the speed of rotation of the encoder 60, in step S1005. By sequentially calculating the sheet feeding speed within a predetermined time, the calculated value of the sheet feeding speed is updated.

Then, in step S1006, it is determined whether or not the rotation of the encoder 60 is stopped. In other words, it is determined that the timing at which the rotation of the encoder 60 is stopped is the timing at which the trailing end of the sheet P passed through the encoder 60. With the calculated sheet feeding speed, a timing at which the trailing end of the lowermost sheet P passes through the sheet feeding nip region N1 that is located at a further downstream side in the sheet feeding direction is calculated.

When the rotation of the encoder 60 is stopped (YES in step S1006), the intermittent sheet feeding mode is executed at the timing at which the trailing end of the lowermost sheet P passes through the sheet feeding nip region N1 based on the thus calculated timing, in step S1007. After step S1007, a timing at which the trailing end of the lowermost sheet P passes through the separation nip region N2 is calculated, and the electromagnetic clutch 600 is turned off at the calculated timing to complete the sheet feeding operation, in step S1008.

By contrast, even when the lowermost sheet P is fed, if the sheet is not the plain paper type but a thick paper (NO in step S1004), the low speed mode is selected, and therefore noise due to vibration does not occur easily. Therefore, the lowermost sheet P is fed not in the intermittent sheet feeding mode but in the low speed mode that is previously set (NO in step S1004), and completes the sheet feeding operation, in step S1008.

Further, when it is detected that the encoder 60 is not rotating in the image forming apparatus 500 (NO in step S903), the sheet that is currently fed is not the lowermost sheet. In this case, it is further determined whether or not the above-described print job instruction indicates a continuous printing of multiple sheets in the image forming apparatus 500, in step S1009. As a result, when the print job instruction indicates a printing of one sheet (NO in step S1009), the intermittent sheet feeding mode is not executed and the sheet feeding operation completes, in step S1008. By contrast, when the print job instruction indicates the continuous printing of multiple sheets (YES in step S1007), the procedure goes back to step S1003 to repeat the same procedure until the continuous printing completes.

As described above in the flowchart of FIG. 30, the intermittent sheet feeding mode is selectively executed when the lowermost sheet P of the plain paper type is fed, in other words, when the lowermost sheet P is fed in the high speed mode. That is, the intermittent sheet feeding mode is not executed in any other cases. Accordingly, deterioration in productivity of image formation and a reduction in service life of the electromagnetic clutch 600 can be prevented.

It is to be noted that the above-described sheet feeding operation of FIG. 30 according to the present embodiment includes two modes, which are the high speed mode and the low speed mode. However, the sheet feed mode is not limited thereto. For example, a sheet feeding operation may include three modes such as a high speed mode, a low speed mode, and an intermediate speed mode. Alternatively, a sheet feeding operation may include four or more modes.

In the above-described embodiments, the intermittent sheet feeding mode is executed before the first sheet reaches the separation nip region N2 or after the last sheet (the lowermost sheet) has passed the sheet feeding nip region N1, during which the sheet feeding is stopped at least one time, so that an increase in vibration is restrained. However, such an increase in vibration can be restrained without temporarily stopping the feeding of the sheet P. That is, an increase in vibration can be restrained by serially rotating the sheet feed roller 32 while relatively reducing the sheet feeding speed. Specifically, by temporarily stopping the sheet feeding at least one time or by relatively reducing the sheet feeding speed, an increase in vibration can be restrained by reducing the average sheet feeding speed.

When relatively reducing the sheet feeding speed, the sheet feed roller 32 can change the sheet feeding speed with a stepping motor, for example. At this time, the number of rotations of the sheet feed roller 32 is set to two pattern, one is 32.08 [rpm] and the other is 93.57 [rpm], so that a high speed mode and a low speed mode can be selected. It is to be noted that the number of rotations of the sheet feed roller 32 is not limited thereto but is changeable accordingly.

When feeding the first sheet, the sheet feed roller 32 is rotated at the low speed mode before the leading end of the first sheet reaches the separation nip region N2 and the sheet feed roller 32 is rotated at the high speed mode after the leading end of the first sheet has reached the separation nip region N2. When feeding the lowermost sheet, the sheet feed roller 32 is rotated at the low speed mode before the trailing end of the first sheet reaches the sheet feeding nip region N1 and the sheet feed roller 32 is rotated at the high speed mode after the trailing end of the first sheet has reached the sheet feeding nip region N1. By so doing, the increase in vibration can be restrained before and after passage of the trailing end of the first sheet through the sheet feeding nip region N1.

Accordingly, as described in the present embodiments above, the average sheet feeding speed at which the sheet feed roller 32 is in contact with the separation pad 51 or the loading face pad 55 without holding the sheet P and the sheet P is fed is smaller than the average sheet feeding speed at which the sheet feed roller 32 is holding the sheet P with the separation pad 51 or the loading face pad 55 and the sheet P is fed. With the configuration(s) above, this disclosure can prevent occurrence of noise caused by vibration.

It is to be noted that, according to this disclosure, as the average sheet feeding speed at which no sheet is held between the sheet feed roller 32 and the separation pad 51 or the loading face pad 55 decreases, the period of time for the sheet feeding increases or becomes longer when compared with a configuration in which the average sheet feeding speed is maintained. However, by increasing the timing to start driving the pair of timing rollers 14 after the average sheet feeding speed has decreased, the sheet feeding operation can be performed without causing a reduction in productivity of image formation.

Further, the configurations in the above-described embodiments restrain vibration generated in a state in which the sheet feed roller 32 contacts the separation pad 51 or the loading face pad 55. However, the configuration applied to this disclosure is not limited thereto. For example, a configuration in which the sheet feed roller 32 contacts a contact member other than the separation pad 51 and the loading face pad 55 is also applicable to prevention of vibration according to this disclosure.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet feeder comprising:

a sheet loader on which a sheet is loaded;

a sheet feeding body to feed the sheet from the sheet loader;

a sheet separator disposed to contact the sheet feeding body; and a controller configured to control the sheet feeding body to feed the sheet at a first average sheet feeding speed when the sheet feeding body is in contact with the sheet separator without holding the sheet with the sheet separator, and feed the sheet at a second average sheet feeding speed when the sheet feeding body is holding the sheet with the sheet separator, wherein the first average sheet feeding speed is smaller than the second average sheet feeding speed.

2. The sheet feeder according to claim 1, wherein the sheet is one of a plurality of sheets in a bundle of sheets and the sheet separator includes a separation pad disposed downstream in a sheet feeding direction from the bundle of sheets loaded on the sheet loader, and wherein, the controller controls the sheet feeding body such that when a first sheet of the bundle of sheets is fed while the sheet feeding body is in contact with the separation pad without any sheet held between the sheet feeding body and the separation pad, the first average sheet feeding speed before a leading end of the first sheet reaches a nip region formed between the sheet feeding body and the separation pad is smaller than the second average sheet feeding speed after the leading end of the first sheet has reached the nip region.

3. The sheet feeder according to claim 2, wherein the controller executes a mode in which the first average sheet feeding speed is reduced when feeding the first sheet of the bundle of sheets after a power on of an image forming apparatus.

4. The sheet feeder according to claim 2, wherein a mode to reduce the first average sheet feeding speed is executed when feeding the first sheet of the bundle of sheets after recovery from a sleep mode that stops power supply to a predetermined device in a case in which image data has not been received for a predetermined period of time.

5. The sheet feeder according to claim 2, wherein a mode to reduce the first average sheet feeding speed is executed when the first sheet is fed after attachment of the sheet loader to an image forming apparatus.

6. The sheet feeder according to claim 2, further comprising a loaded sheet detector to detect whether or not the bundle of sheets is loaded on the sheet loader, wherein the controller executes a mode in which the first average sheet feeding speed is reduced when feeding the first sheet of the bundle of sheets after the loaded sheet detector has detected presence of the sheet.

7. The sheet feeder according to claim 2, wherein the sheet loader includes multiple sheet loaders, and wherein a mode to reduce the first average sheet feeding speed is executed when feeding the first sheet after one sheet loader of the multiple sheet loaders is changed to another sheet loader of the multiple sheet loaders.

8. The sheet feeder according to claim 2, wherein a mode to reduce the first average sheet feeding speed is executed when feeding the first sheet is fed after recovery from an abnormal suspension state.

9. The sheet feeder according to claim 2, further comprising a nipped sheet detector to detect whether the leading end of the first sheet is at the nip region, wherein the first average sheet feeding speed decreases before the nipped sheet detector detects the sheet and the second average sheet feeding speed does not decrease after the nipped sheet detector has detected the sheet.

10. The sheet feeder according to claim 2, further comprising a sheet travel distance measuring device to measure a sheet travel distance of the sheet from the sheet loader, wherein the first average sheet feeding speed decreases when the sheet travel distance measured by the sheet travel distance measuring device is less than a distance from a sheet feeding start position to the nip region, and wherein the first average sheet feeding speed does not decrease when the sheet travel distance measured by the sheet travel distance measuring device is equal to or greater than the distance from the sheet feeding start position to the nip region.

11. The sheet feeder according to claim 1, wherein the sheet includes a bundle of sheets and the sheet separator includes a loading face pad mounted on a loading face on which the bundle of sheets is loaded in the sheet loader, wherein the sheet includes a lowermost sheet placed on a lowest position of the bundle of sheets in the sheet loader, and wherein, when the lowermost sheet is fed, the first average sheet feeding speed after a trailing end of the lowermost sheet has passed through a nip region formed between the sheet feeding body and the loading face pad is smaller than the second average sheet feeding speed before the trailing end of the lowermost sheet passes through the nip region.

12. The sheet feeder according to claim 11, further comprising a sheet transfer body disposed downstream from the sheet feeding body in a sheet feeding direction to temporarily stop a sheet feeding operation and restart the sheet feeding operation, wherein, when the lowermost sheet is fed, the first average sheet feeding speed after the trailing end of the lowermost sheet has passed through the nip region formed between the sheet feeding body and the loading face pad is greater than the second average sheet feeding speed before the trailing end of the lowermost sheet passes through the nip region.

13. The sheet feeder according to claim 11, further comprising a sheet transfer body disposed downstream from the sheet feeding body in a sheet feeding direction to temporarily stop a sheet feeding operation before restarting the sheet feeding operation, wherein the sheet slackens when the sheet transfer body temporarily stops the sheet feeding operation, and wherein an amount of slack of the sheet is variable according to a length of the sheet.

14. The sheet feeder according to claim 1, wherein the controller is configured such that the first average sheet feeding speed decreases after the sheet feeding body stops at least one time during a sheet feeding operation.

15. The sheet feeder according to claim 1, wherein the controller is configured such that the first average sheet feeding speed decreases relatively in response to a reduction in a sheet feeding speed of the sheet feeding body.

16. The sheet feeder according to claim 1, wherein a type of the sheet determines whether to execute a mode to reduce the first average sheet feeding speed.

17. The sheet feeder according to claim 1, wherein a setting of a sheet feeding speed determines whether to execute a mode to reduce the first average sheet feeding speed.

18. The sheet feeder according to claim 1, further comprising a drive power transmitter configured to transmit a driving force from a drive source to the sheet feeding body and interrupt transmission of the driving force from the drive source to the sheet feeding body.

19. An image forming apparatus comprising the sheet feeder according to claim 1 to feed the sheet.

20. An image forming apparatus comprising:

an image forming device to form an image on a sheet; and the sheet feeder according to claim 1 to feed the sheet to the image forming device.

* * * * *